US005979344A

United States Patent [19]

Christman, Jr.

[11] Patent Number: 5,979,344

[45] Date of Patent: Nov. 9, 1999

[54] TUFTING MACHINE WITH PRECISION DRIVE SYSTEM

[75] Inventor: William M. Christman, Jr., Hixson, Tenn.

[73] Assignee: Card-Monroe Corp., Hixson, Tenn.

[21] Appl. No.: 08/996,559

[22] Filed: Dec. 23, 1997

Related U.S. Application Data

[60] Provisional application No. 60/037,012, Jan. 31, 1997.

[51] Int. Cl.[6] ..... D05B 15/28; D05B 15/36

[52] U.S. Cl. ..... 112/80.23; 112/80.41; 112/80.55

[58] Field of Search ..... 112/80.41, 80.23, 112/80.01, 80.4, 80.45, 80.55, 80.56, 80.7

[56] References Cited

U.S. PATENT DOCUMENTS

| | | | |
|---|---|---|---|
| 3,026,830 | 3/1962 | Bryant et al. | 112/79 |
| 3,361,096 | 1/1968 | Watkins | 112/79 |
| 3,435,787 | 4/1969 | Short | 112/79 |
| 3,806,013 | 4/1974 | McGann | 226/19 |
| 3,881,432 | 5/1975 | Dodd et al. | 112/221 |

(List continued on next page.)

FOREIGN PATENT DOCUMENTS

| | | |
|---|---|---|
| 0 483 101 A1 | 10/1991 | European Pat. Off. . |
| 27 55 868 A1 | 6/1978 | Germany . |
| 28 34 723 | 3/1979 | Germany . |
| 49-126457 | 12/1974 | Japan . |
| 60-37215 | 6/1979 | Japan . |

(List continued on next page.)

OTHER PUBLICATIONS

Telefax/description of Zeiseniss Electronic Yarn Feed System, Feb. 16, 1988.

Zeiseniss Electronic Yarn Feed Advertisements (w/translation), 1987.

Tufting Machine Control Technical Specification, Moog, Inc., Jun. 1987.

MTS Systems Corporation Proposal to Tuftco Corp. for Computer Controled Tufting Machine, Oct. 21, 1986.

"Moving Toward Total Automation," *Carpet & Rug Industry*, Dec. 1990, p. 22.

"Tufting Technology Still Ahead of Its Time," *Carpet & Rug Industry*, Dec. 1991, p. 21.

"News in Tufting & Weaving Technology," *Carpet & Rug Industry*, Mar. 1994, p. 10.

"New Products," *Carpet & Rug Industry*, Feb. 1991, p. 32.

"Innovations in tufting machinery design," Melliand English, Jan. 1991, p. 11.

"Neue Entwicklungen bel der Teppichherstellung," *Melliand Textilberichte*, Jan., 1991, p. 29.

Superspeed Compucam: Card–Monroe Corporation brochure (1982).

Micromatic II: Stitch Displacement Pattern Attachment (1987 or earlier).

Exlar Corporation, Chanhassen, Minnesota, Exlar Product Specifications—GS Series Linear Actuators, Jul. 1996.

*Primary Examiner*—Peter Nerbun

*Attorney, Agent, or Firm*—Womble Carlyle Sandridge & Rice, PLLC

[57] ABSTRACT

An improved tufting machine with a precision drive system for laterally shifting the reciprocating needle bars of the tufting machine across a tufting zone in which tufts of yarn are made in a backing material advanced through the machine beneath the needle bars is disclosed. The precision drive system includes the use of inverse roller screw actuators which may be adapted for driving the several moving components of the tufting machine, to include not only the shifting of the needle bars, but also can be used to reciprocate the needle bars toward and away from the tufting zone, rock the loopers and or knives of the machine, and to shift the backing material in which the tufts of yarn are made as it advances through the tufting machine.

96 Claims, 18 Drawing Sheets

U.S. PATENT DOCUMENTS

| | | | |
|---|---|---|---|
| 3,943,865 | 3/1976 | Short et al. | 112/79 |
| 3,972,295 | 8/1976 | Smith | 112/79 |
| 3,982,491 | 9/1976 | Herzer et al. | 112/121.12 |
| 4,010,700 | 3/1977 | Webb | 112/112.79 |
| 4,089,281 | 5/1978 | Landoni | 112/221 |
| 4,173,192 | 11/1979 | Schmidt et al. | 112/79 |
| 4,267,787 | 5/1981 | Fukuda | 112/266.2 |
| 4,365,565 | 12/1982 | Kawai et al. | 112/103 |
| 4,366,761 | 1/1983 | Card | 112/79 |
| 4,399,758 | 8/1983 | Bagnall | 112/79 |
| 4,419,944 | 12/1983 | Passons et al. | 112/79 |
| 4,440,102 | 4/1984 | Card et al. | 112/266.2 |
| 4,445,447 | 5/1984 | Bardsley | 112/79 |
| 4,483,260 | 11/1984 | Gallant | 112/79 |
| 4,519,332 | 5/1985 | Fukuda | 112/266.2 |
| 4,549,496 | 10/1985 | Kile | 112/79.5 |
| 4,586,445 | 5/1986 | Card et al. | 112/79 |
| 4,597,344 | 7/1986 | Stutznäcker | 112/262.3 |
| 4,619,212 | 10/1986 | Card et al. | 112/266.2 |
| 4,630,558 | 12/1986 | Card et al. | 112/266.2 |
| 4,653,293 | 3/1987 | Porat | 66/207 |
| 4,653,413 | 3/1987 | Bagnall | 112/80.41 |
| 4,665,845 | 5/1987 | Card et al. | 112/80.4 |
| 4,669,171 | 6/1987 | Card et al. | 29/446 |
| 4,682,554 | 7/1987 | Goto et al. | 112/262.1 |
| 4,686,918 | 8/1987 | Hjalmer et al. | 112/410 |
| 4,829,917 | 5/1989 | Morgante et al. | 112/80.41 |
| 4,867,080 | 9/1989 | Taylor et al. | 112/80.32 |
| 4,981,091 | 1/1991 | Taylor et al. | 112/80.32 |
| 5,005,498 | 4/1991 | Taylor et al. | 112/80.32 |
| 5,058,518 | 10/1991 | Card et al. | 112/266.2 |
| 5,080,028 | 1/1992 | Ingram | 112/80.08 |
| 5,205,233 | 4/1993 | Ingram | 112/266.2 |
| 5,224,434 | 7/1993 | Card et al. | 112/80.41 |
| 5,295,450 | 3/1994 | Neely | 112/80.45 |
| 5,383,415 | 1/1995 | Padgett, III | 112/266.2 |
| 5,392,723 | 2/1995 | Kaju | 112/80.23 |
| 5,491,372 | 2/1996 | Erhart | 310/80 |
| 5,513,586 | 5/1996 | Neely et al. | 112/80.01 |
| 5,526,760 | 6/1996 | Ok | 112/80.41 |
| 5,544,605 | 8/1996 | Frost | 112/475.23 |
| 5,549,064 | 8/1996 | Padgett, III | 112/410 |
| 5,557,154 | 9/1996 | Erhart | 310/80 |
| 5,562,056 | 10/1996 | Christman, Jr. | 112/80.33 |
| 5,566,630 | 10/1996 | Burgess et al. | 112/80.41 |
| 5,588,383 | 12/1996 | Davis et al. | 112/80.16 |
| 5,706,745 | 1/1998 | Neely et al. | 112/80.55 |
| 5,738,030 | 4/1998 | Ok | 112/475.23 |
| 5,794,551 | 8/1998 | Morrison et al. | 112/80.41 |
| 5,806,446 | 9/1998 | Morrison et al. | 112/80.73 |
| 5,809,917 | 9/1998 | McGowan et al. | 112/80.32 |
| B1 4,981,091 | 3/1995 | Taylor et al. | 112/80.32 |

FOREIGN PATENT DOCUMENTS

| | | |
|---|---|---|
| 58-174672 | 1/1982 | Japan . |
| 4-50411 | 11/1985 | Japan . |
| 2-41457 | 2/1990 | Japan . |
| 3-237991 | 2/1990 | Japan . |
| 5-321126 | 8/1992 | Japan . |
| 7-109052 | 1/1993 | Japan . |
| 7-109052 | 11/1995 | Japan . |
| 1304151 | 1/1973 | United Kingdom . |
| 1 507 201 | 4/1978 | United Kingdom . |
| 2 004 571 | 7/1978 | United Kingdom . |
| 1 545 258 | 5/1979 | United Kingdom . |
| 2 144 778 | 3/1985 | United Kingdom . |
| 2216553A | 10/1989 | United Kingdom . |
| 2 242 205 | 9/1991 | United Kingdom . |

TUFTING MACHINE WITH PRECISION DRIVE SYSTEM

CROSS-REFERENCE TO RELATED APPLICATION

This is a utility application prepared from Provisional Patent Application, Ser. No. 60/037,012, filed in the United States Patent and Trademark Office on Jan. 31, 1997.

FIELD OF THE INVENTION

This invention relates in general to tufting machines. More particularly, this invention relates to a tufting machine using linear actuators to operate the needle drive, looper drive, and/or knife drive systems, as well as using a linear actuator to shift the needle bar laterally.

BACKGROUND OF THE INVENTION

The use of tufting machines to create tufted articles, for example tufted carpet, is well known. Conventional tufting machines use a reciprocating needle bar carrying a plurality of aligned needles, the needles being constructed and arranged to reciprocably penetrate a backing material passing underneath the needle bar on a bed, including a bed plate section, a bedrail and needle plate. As the needles penetrate the backing material, they carry yarn through the backing which is caught either by a looper to create a looped pile article, or by a hook moving in timed relationship with a knife to create a loop which is then cut to create a cut pile article. It is by these well known processes, for example, that looped pile and tufted cut pile carpeting is made.

Early tufting machines used mechanical devices to reciprocate the needle bar, the loopers, and the looper/knife arrangement of the machine in timed relationship with one another to accomplish this tufting operation. This arrangement included a main drive shaft which was rotated by a drive source, usually a motor. The drive shaft is positioned above the needle bar or bars in the head of the tufting machine, extending from one side to the other, transverse to the direction of backing moving through the machine. As the main drive shaft is rotated, it moves a series of spaced, vertical push rods, which are fastened through connecting elements to the needle bar, toward and away from the bed section and the backing material, as well as moving the looper and/or the hook/knife combination in timed relationship with the reciprocation of the needles. This has been done by using pinions or cams mounted on the main drive shift to reciprocate the push rods, while also using push rods or straps engaged with additional cams positioned on the main drive shaft to operate the looper and/or the looper/knife mechanisms.

Although these tufting machines have proven to be durable and capable of creating a high quality tufted product, an inherent problem has been their reliance upon mechanical connections, i.e. the interlinking of mechanical levers or straps to reciprocate the needle bar, the looper drive, and/or the looper/knife drives. These mechanical connections create a significant amount of mechanical drag, which leads to the creation of heat and increased friction and increased wear and vibration in the drive train. An example of an early tufting machine which uses a mechanical drive system is disclosed in U.S. Pat. No. 3,361,096 to Watkins, as well as in British Patent No. 1,507,201 and British Patent No. 1,304,151.

In the effort to move away from using tufting machines having cams and straps, the use of belt drives for these components was developed. An example of this approach in powering a tufting machine component is the multiple stroke looper mechanism for a stitching machine disclosed in U.S. Pat. No. 4,419,944 to Passons, et al. Passons, et al. passes a drive chain over a sprocket on the drive shaft, with a spaced second sprocket being attached to a cam shaft used to reciprocate a push rod for rocking the loopers in timed relationship with the reciprocation of the needles. A mechanical drive system is still disclosed, which drive system is subject to the inherent problems of mechanical wear, stress, and vibration.

U.S. Pat. Nos. 4,586,445 and 4,665,845 to Card, et al., respectively, disclose a high speed tufting machine using a flexible timing belt to vertically reciprocate the needle bar by transmitting the rotation of the tufting machine drive shaft to a series of aligned sprockets, and including a push rod as a part of a crank mechanism for reciprocating the needle bar. Although these two patents to Card, et al. represented a significant advance in the art by allowing still greater production speeds, Card, et al. did not address the limitation of using the tufting machine main drive shaft for mechanically powering, either directly or indirectly, the driven components in an adjustable timed relationship.

Additional examples of advances in the art are disclosed in U.S. Pat. No. 5,513,586 to Neely, et al., in which a belt driven looper drive assembly is disclosed, as well as in U.S. Pat. No. 5,706,745 to Neely et al., which discloses a belt driven looper and knife drive system.

During the evolution of the tufting machine, the use of laterally shiftable needle bars has also arisen. This is done in order to shift the needles, and thus the yarn carried by these needles with respect to the backing material, to produce carpet with a "graphic" pattern. Another type of tufting machine is disclosed in U.S. Pat. No. 3,026,830 to Bryant et al. which uses a disc-shaped cam, the rotation of which is synchronized with the reciprocation of the needles, and thus the main drive shaft, to shift the needle bar laterally in timed relationship with the reciprocation of the needles.

A tufting machine and tufting method for producing multiple rows of tufts with single lengths of yarn is disclosed in U.S. Pat. No. 4,440,102 to Card, et al. This device uses a cam disc rotated in timed relationship with the rotation of the tufting machine main drive shaft. The cam disc has a pre-determined cam profile, with cam followers riding over the periphery of the cam. The cam followers are operably fastened to a shifting bar which engages the needle bar for transversely shifting the needle bar with respect to the backing material, and the loopers beneath the backing material, for producing tufted articles. Another shiftable needle bar tufting machine is disclosed in U.S. Pat. No. 5,224,434 to Card, et al., which utilized cam rollers riding on opposite sides of the periphery of a pair of spaced cam discs. The cam discs are spaced on opposite sides of a needle bar and used together for transversely shifting the needle bar with respect to the backing material for creating tufted articles in a variety of patterns.

Although these devices utilizing cam discs for transversely shifting the needle bar have proven to be durable and reliable, they are subject to wear. Further, a specific cam profile is needed for each specific pattern required, requiring machine shutdown in order to change over the cam discs to change the pattern of the tufted articles being produced. Moreover, the use of a cam disc system is speed limited by the ability to drive a mechanical system without inducing excess machine vibration and stress.

One approach that sought to minimize the use of mechanical components in shifting needle bars to produce pattern-tufted articles is disclosed in U.S. Pat. No. 4,173,192 to Schmidt, et al. In Schmidt, et al., a hydraulic actuator is used to shift a needle bar transversely with respect to the backing material, the system having an electronic pattern control mechanism controlling the actuator in response to a predetermined stitch pattern. Although the device of Schmidt, et al. relies less upon a mechanical drive train for moving the needle bar transversely, it relies instead upon the use of a hydraulic actuator. This system requires the use of a motor, a hydraulic pump, hydraulic piping, and a hydraulic cylinder, which are subject to wear and which operate under high pressure, thus inducing machine stress, noise, and vibration.

In many tufting applications, the needle bar must be shifted frequently and at high rates of speed, which may result in induced machine stress and component wear. The hydraulic fluid of such a system typically is used to lubricate and cool the system, all of which can allow for hydraulic fluid to be degraded or become contaminated, which may lead to damage of the hydraulic pump, and/or the ported servo-valve controlling the device of Schmidt, et al., thus making the system less reliable. In using a hydraulic cylinder for shifting the needle bar, the problems of hydraulic lag and surge, and/or compression and shock of the hydraulic fluid, occurs, in which precise control of the shifting of the needle bar with respect to the backing material may be adversely affected. Schmidt, et al. also introduced a control system which required the use of a number of external position sensors, as well as a separate pump, motor, cylinder, and/or cylinders, and a servo valve for each cylinder to accomplish the shifting of the needle bar.

The device of Schmidt, et al. was modified in U.S. Pat. No. 4,829,917 to Morgante, et al. Morgante, et al. uses a computer to control the velocity of the transverse movement of the needle bar, accomplished by the hydraulic cylinder, so as to minimize any shock created by the transverse movement of the needle bar. This was achieved by signaling the commencement of the shifting of the needle bar prior to its actual shifting, and by signaling the termination of the shifting prior to the termination of the actual shifting in order to counteract any delayed inertial movement, i.e. fluid shock or compression, in the hydraulic cylinder during the movement of the needle bar in response to the computer command signals. Thus, Morgante, et al. sought to improve the control of the hydraulic actuator.

What has been needed, therefore, but seemingly unavailable in the art is an improved tufting machine having a precision drive system which reduces or moves away from the mechanical interlinkage of the needle bar drive, the shifting of the needle bar, the looper drive, and/or the looper/knife drive systems so that one or more of these components of the tufting machine is powered separately, yet all still work in timed relationship with one another at a high degree of precision.

The known devices are not constructed to perform this task, nor to fulfill these needs, and they fail to suggest how this may reasonably be accomplished. What is provided, therefore, is an improved tufting machine with a precision drive system using a machine controller, typically a computer or computing system, to control either selected or all tufting operations, including the reciprocation of the needle bar, shifting the needle bar, as well as the rocking of the loopers and/or the looper/knives in precise, timed, programmable relationship with one another, yet which eliminates the drive system in which the operation of any one component is mechanically linked to all other components.

SUMMARY OF THE INVENTION

The tufting machine precision drive system of this invention provides a tufting machine, and a drive system for operating the major operational components of the tufting machine, including reciprocating the needle bar, or needle bars and/or shifting the needle bar or bars, and/or reciprocating the loopers or the hooks and knives for creating tufted looped pile and cut pile articles or combinations thereof. This invention also provides an efficient precision drive system for use with tufting machines which is well suited for use with a large number of tufted article types and configurations, and which eliminates a single drive system that includes the mechanical linkage of the main drive shaft, the needle bar drive, looper drive, looper/knife drive, as well as for the shifting of the needle bar, since each of these components can be separately powered by a linear actuator, or actuators.

This invention attains this high degree of flexibility and precision, yet maintains simplicity in design and operation, by providing a tufting machine having a programmable, software based control system executed by a control processor controlling the operation of the precision drive system without the use of mechanical followers or indexing devices. In one configuration, the needle bar is vertically reciprocated with respect to the backing material by the control processor communicating with at least one linear actuator, and preferably a spaced series of linear actuators operated in unison, to reciprocate the needle bar; at least one linear actuator to simultaneously shift the needle bar transversely with respect to, and in timed relationship with the path of movement of the backing material, and the reciprocation of the needles, through a tufting zone defined on the machine; at least one linear actuator to simultaneously control the movement of the loopers in timed relationship toward and away from the needles after they have penetrated the backing material; and at least one additional linear actuator, where appropriate, for simultaneously controlling the motion of the of a cut pile tufting machine for creating tufted cut pile articles. Each of these linear actuators may be digitally controlled, analog controlled, or controlled by a digital-analog system, as desired, and wired to the centralized control processor through control interfacing. The control processor is adapted to control not only the operation of these linear actuators, but also may be adapted to control the yarn feed of the tufting machine, and the movement of the backing material over the bedrail during tufting operations, as well as controlling the positioning of the bedrail by utilizing a series of separately provided servo-motors and/or actuators for accomplishing this task, in the fashion well known in the art and as generally described in U.S. Pat. No. 4,867,080 to Taylor, et al.

DETAILED DESCRIPTION OF THE PREFERRED EMBODIMENTS

Figure 1:
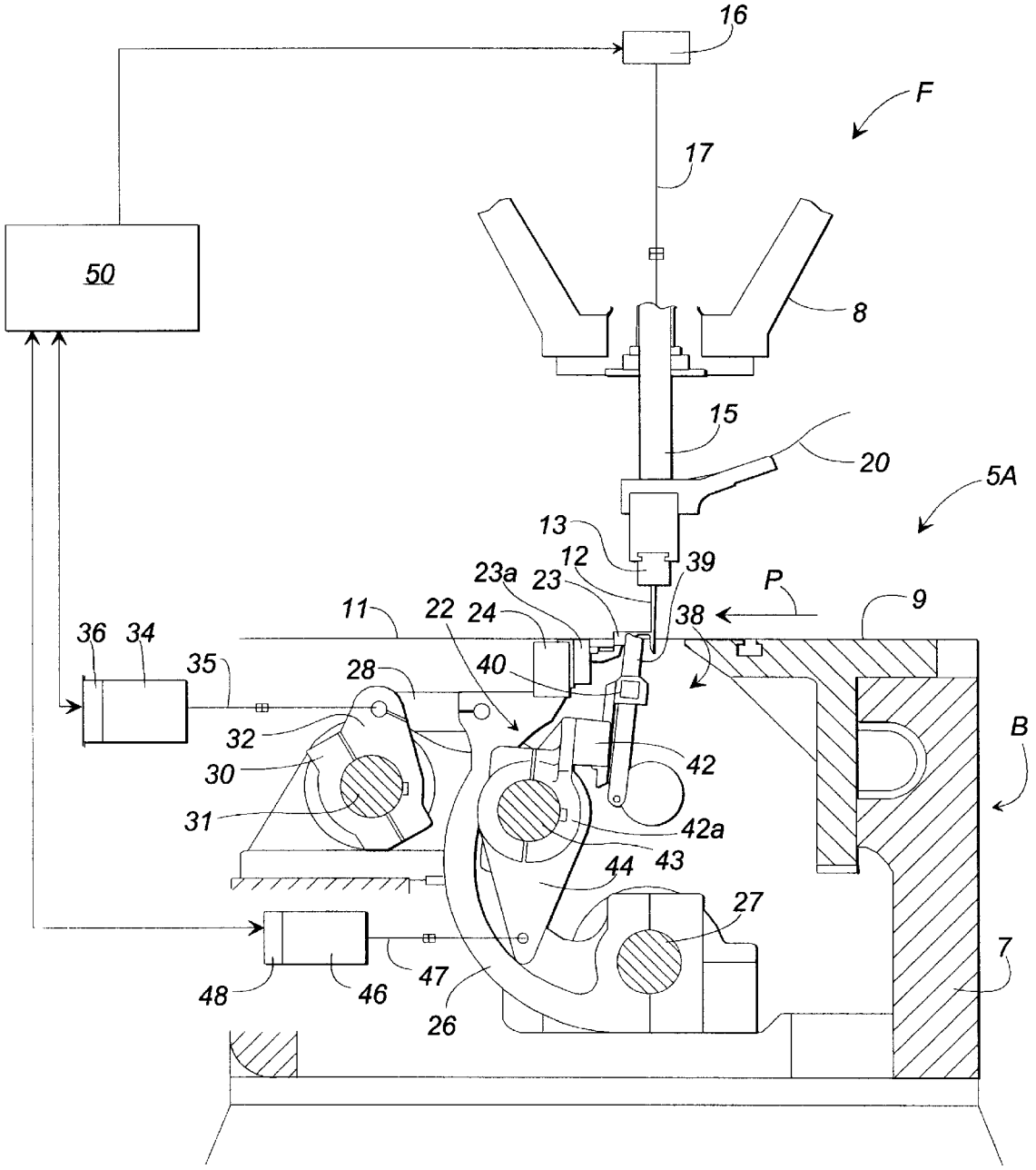
FIG. 1 is a partially cross-sectioned end elevational view of a cut pile tufting machine schematically illustrating the precision control system of this invention.

Referring now to the drawings, in which like reference characters indicate like parts throughout the several views, numeral 5A in FIG. 1 refers to a cut pile tufting machine of a general type known to those skilled in the art. The tufting machine has a frame F which includes an upper section or head 8 spaced above a lower section or bed B over which a generally continuous backing material 11 is moved by one or more backing material feed rollers (not illustrated) of a type known to those skilled in the art. As is well known in the art, the bed section B of tufting machines generally include a bed plate 7 and/or a bedrail 9. If the bed B includes a bedrail 9, the bedrail 9 can be selectively adjustable vertically to alter the pile height of the tufted product. Backing material 11 moves over the bed B in the path or direction of the arrow marked by the reference character "P".

The tufting machine includes an elongate series of spaced needles 12, although only one needle 12 is shown in FIG. 1. Each needle 12 is mounted to a needle bar 13. Needle bar 13 is supported for reciprocal motion so that the needles may be moved toward and away from backing material 11 in reciprocable fashion, and so that needles 12 reciprocably penetrate backing material 11 so that needle 12 cooperates with looper 23 and knife 39 for creating cut pile tufted articles. Needle bar 13 is mounted to at least one push rod 15, which is suitably journaled on head 8 for reciprocable motion toward and away from backing material 11. Push rod 15 extends toward and into operable engagement with a linear actuator 16.

Actuator 16 has an elongate actuator shaft 17, and is engaged with push rod 15 by conventional means, to include being threadably coupled or fastened, or by being linked by a pin, i.e. through a clevice arrangement or other pivotal pin arrangement, so that actuator 16, and in particular actuator shaft 17, can be disconnected from push rod 15. Actuator 16 includes a position feedback device 19, for example an encoder or linear transducer, for emitting a digital or an analog data position signal to a control processor or computing system 50, illustrated schematically in FIGS. 1 and 3.

Positioned on frame F of the tufting machine is a cut pile looper or hook assembly 22, having a spaced, parallel series of loopers or hooks 23, the hooks being mounted to a hook block 23*a,* the hook block being fastened to a gauge bar 24 mounted, or carried on, a spaced series of rocker arms 26, one of which is shown in FIG. 1. The rocker arm 26 has a pivot shaft 27 about which the rocker arm rotates in a partially circular motion. Hook assembly 22 includes an intermediate link 28 extending from rocker arm 26 to a clamp 30 clamped onto an elongate hook drive shaft 31 as known to those of skill in the art. Clamp 30 includes a lever 32 to which intermediate link 28 may be fastened, and to which the shaft of a second linear actuator 34 is also fastened for operating, i.e. rocking, drive shaft 31, and in turn rocking cut pile hook assembly 22 in the direction of the indicational arrows A illustrated on FIG. 1.

Actuator 34 includes in elongate actuator shaft 35 fastened to lever 32 in fashion similar to the manner in which actuator shaft or rod 17 is fastened to push rod 15. Actuator 34 also includes a position feedback device 36 for signaling the rotational position of the servo-motor (not illustrated) or the armature of the actuator, which in turn is translated into the linear position of actuator shaft 35 by the appropriate software program within control processor or computing system 50.

Tufting machine 5A of FIG. 1 also includes a knife assembly 38 which works in conjunction with hook assembly 22, and has a spaced, parallel series of knives 39 mounted on a mounting block assembly 40. Mounting block assembly 40 is fastened to a gauge bar 42, which is carried by a clamp 42*a* secured to an elongate knife drive shaft 43 in known fashion. Clamp 42*a* includes a lever 44 to which a third linear actuator 46 is attached. Actuator 46 has an elongate actuator shaft 47 fastened to lever 44 in fashion similar to the attachment of actuators 16 and 34 to push rod 15 and clamp 30, respectively. Actuator 46 also is provided with a position feedback device 48 which provides a position signal to control processor 50, in fashion similar to encoder 36.

Figure 2:
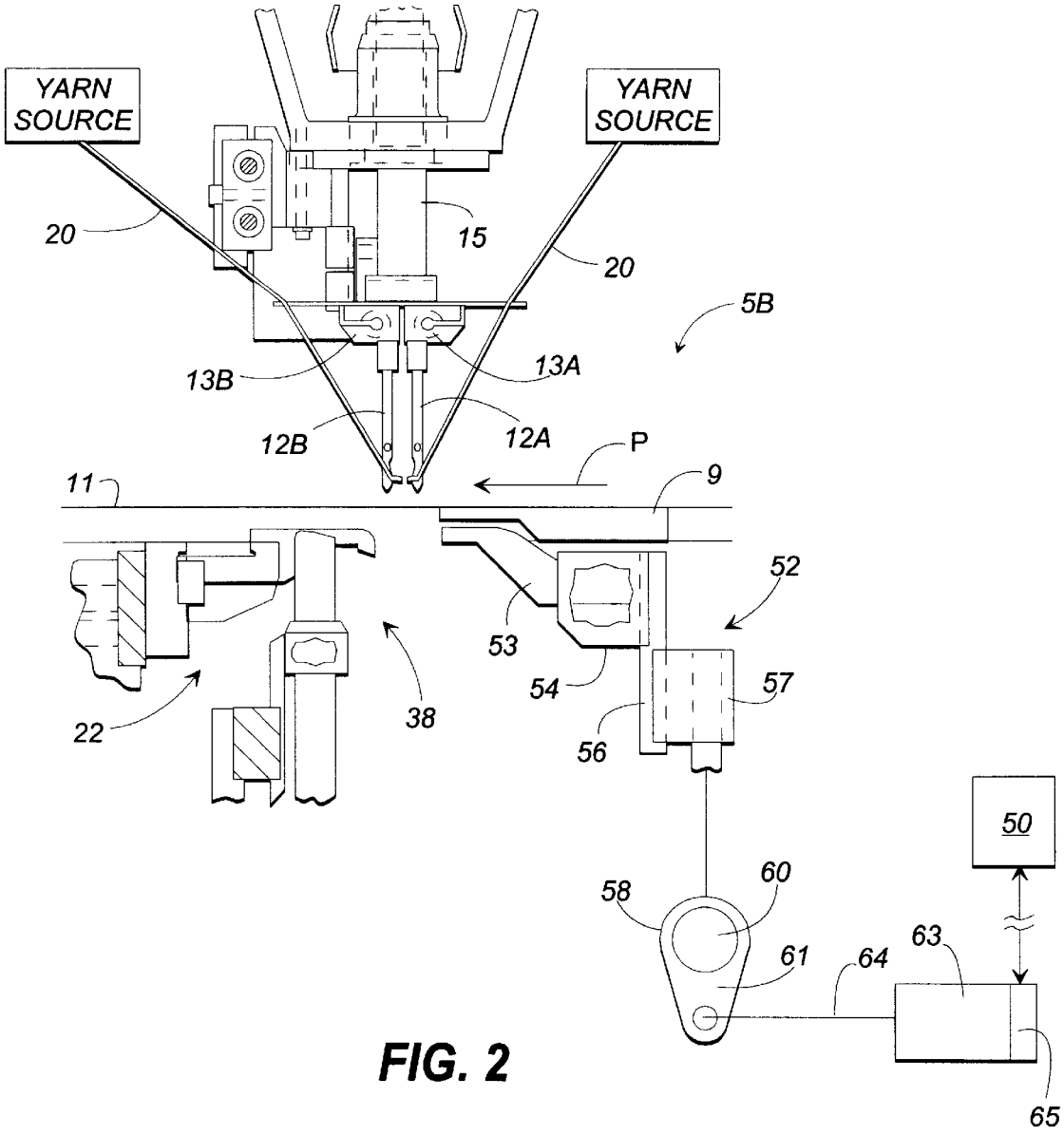
FIG. 2 is a partially cross-sectioned end elevational view with an alternate arrangement of a dual shiftable needle bar tufting machine schematically illustrating the precision drive system of the invention in use with a cut and looped pile tufting machine.

Although only one actuator 16, 34, and 46 for push rod 15, cut pile hook assembly 22 and knife assembly 38, respectively, are shown, it is anticipated that a spaced series of actuators may be provided for reciprocating needle bar 13, for rocking looper drive shaft 31, and for rocking knife drive shaft 43. In this instance, the actuators would be spaced along the width of the tufting machine, the width of the tufting machine being indicated generally in FIGS. 5A and 5B, it being understood by those of skill in the art that backing material 11 passes over the tufting machine from front to rear in the direction of path P as shown in FIGS. 1 and 2. It also is understood by those of skill in the art that separate actuators 34 and 46 need not be provided for the cut pile hook assembly 22, and knife assembly 38, rather either a single actuator, or a spaced series of actuators, could operate both looper assembly 22 and knife assembly 38 by having the knife drive shaft 43 mechanically linked to looper drive shaft 31 so that one actuator, or a spaced series of actuators, can rock both shafts together in unison. This is illustrated schematically in FIGS. 8A–8B. However, and if desired, separate actuators can be provided as illustrated in FIG. 1, and described hereinabove.

Tufting machine 5B (FIG. 2) illustrates a cut and looped pile tufting machine having dual shiftable needle bars, which feature is known to those of skill in the art. Tufting machine 5B has a vertically adjustable bedrail 9. Although not illustrated in FIGS. 1 and 2, bedrail 9 can be adjusted and positioned by the use of the computer controlled tufting machine and process well known in the art and as generally disclosed in U.S. Pat. Nos. 4,867,080, 4,981,091,B1 4,981,091, and 5,005,498 to Taylor, et al. Accordingly, control processor or computing system 50 illustrated in FIGS. 1, 2 and 3 also may be a part of the computer controlled tufting machine of the patents to Taylor, et al., such that it is integrated with the computer of the patents to Taylor, et al., to control all of the principal components of the tufting machine, including the reciprocation of needle bars 13*a* and 13*b,* which carry needles 12A and 12B in respective rows, the rocking of looper drive shaft 31 and looper drive shaft 60, knife drive shaft 43, and the lateral shifting of needle bars 13*a* and 13*b,* as illustrated schematically in FIGS. 3A–3B, all in unison with the control of the feed of yarns 20 to the tufting machine, the indexing of backing material 11 across the tufting machine, and the adjustment of bedrail 9. In this fashion, it is anticipated that the precision drive system of this invention could be used as a part of both a digitally controlled or analog controlled and "shaftless" tufting machine, that is which dispenses entirely with the known tufting machine main drive shaft to which the reciprocation of the needle bars, the lateral shifting of the needle bars with respect to one another and to the backing material, as well as the rocking of the loopers and knives has been mechanically linked.

As shown in FIG. 2, in addition to hook assembly 22 and knife assembly 38, tufting machine 5B has a loop pile looper assembly 52, having a spaced, parallel series of loopers 53 each of which is attached to a block 54. The block 54 is fastened to a staff 56 in known fashion, the staff 56 being secured to bar 57 which is fastened to an elongate rod 59. The distal end of rod 59 is attached to clamp 58, which is passed around and secured to an elongate looper drive shaft 60. Clamp 58 includes a lever 61 to which a linear actuator 63 is coupled, actuator 63 being identical in structure and function to actuators 16, 34, and 46 of FIG. 1. Actuator 63 includes an elongate actuator shaft 64, and a position feedback device 65 for emitting a control signal of the position of the actuator armature (not illustrated), equating to the linear position of actuator shaft 64, to control processor 50.

Figure 3A:
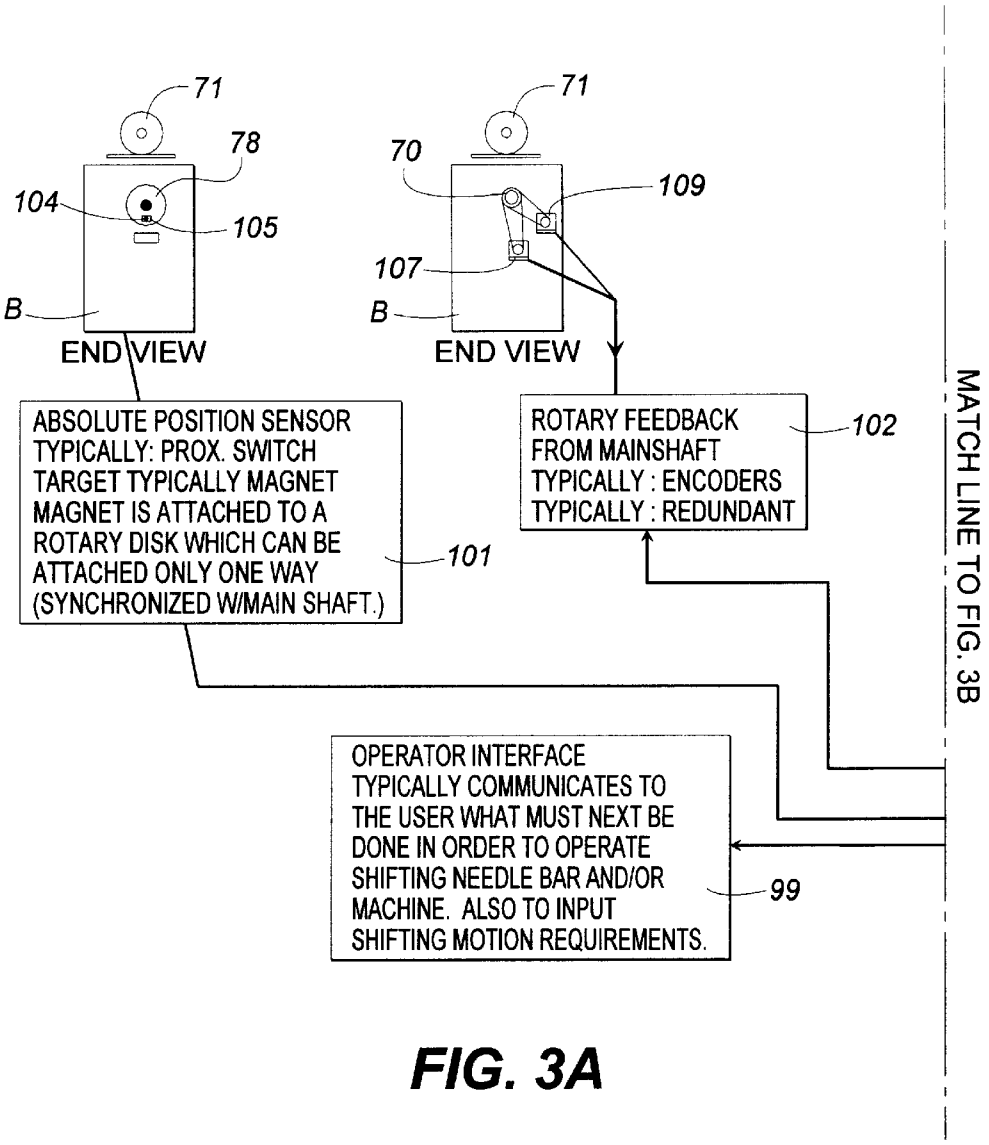
FIG. 3 is a schematic illustration of the precision control system of the invention used with a transversely shiftable needle bar or bars.
Figure 3B:
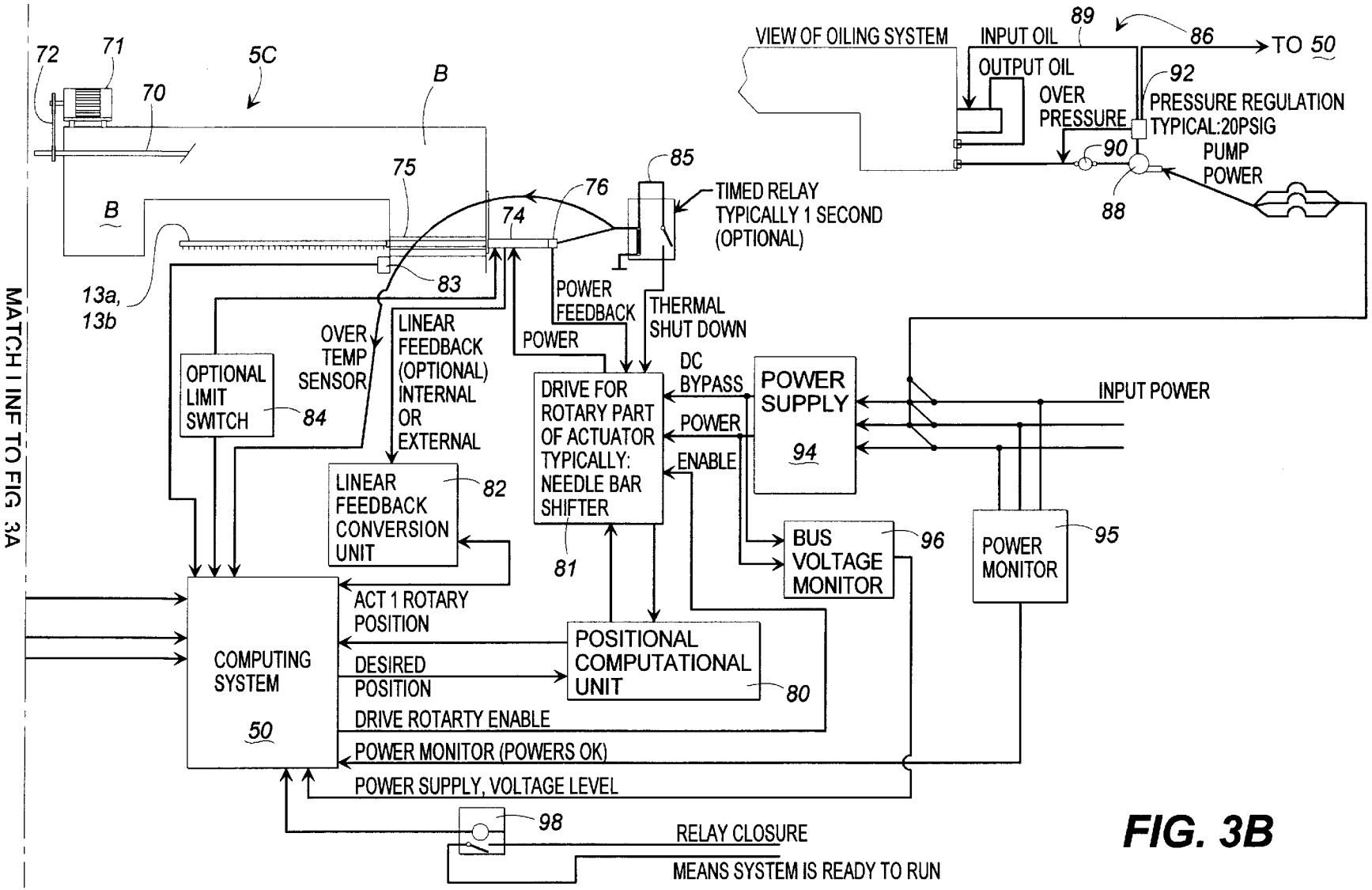

FIGS. 3A–3B and 6A–6B–11A–11B schematically illustrate various embodiments of the present invention along with associated control systems. These figures also include one or more end views of the tufting machine for illustration purposes. FIGS. 3A–3B illustrate a control schematic of the control system of this invention used to laterally shift needle bar 13, or needle bars 13*a* and 13*b,* as appropriate, to create patterned tufted articles on an otherwise conventional tufting machine 5C. Where more than one needle bar exists, for example two needle bars as shown in FIG. 2, a separate linear actuator 74 (FIGS. 3A–3B) is provided for each needle bar, each such actuator having a separate drive 81, feedback device 82, and optional proximity switch 83, but otherwise sharing the remaining components of the control system, as shown generally in FIGS. 6–11. Therefore, although only one needle bar 13 is shown in FIGS. 3A–3B for illustration, it should be understood that the description of the control components and methods described with respect to shifting a single needle bar also apply to shifting two needle bars 13*a* and 13*b* if this system is used on a dual shiftable tufting machine. Tufting machine 5C has a frame F on which a needle bar 13, or two needle bars 13*a* and 13*b,* as desired, are supported for reciprocation as disclosed generally in FIGS. 1 and 2, and in known fashion, so that needles 12 will penetrate a backing material 11 (not illustrated) for creating tufted articles. The tufting machine 5C of FIGS. 3A–3B has an elongate main drive shaft 70 being rotated by a motor or motors 71 through a drive train 72, drive train 72 being either a flexible timing belt, a drive chain, or a mechanical gear train, as desired. Although tufting machine 5C is shown with this main drive shaft, the novel precision drive system of this invention also can eliminate the main drive shaft 70, as well as motor 71 and drive train 72 if so desired, and replace these with a spaced series of linear actuators 16 (FIGS. 1, 7, and 11) such that control processor 50 will not need to receive signals from an absolute position sensor assembly 101, or from a rotary feedback assembly 102, illustrated in FIGS. 3A–3B, to accomplish the control of the tufting machine. Absolute position sensor assembly 101 (comprised of magnet 104, disk 78 and sensor 105), as well as rotary feedback assembly 102 may comprise any of the known devices of indexing the rotation of tufting machine main shaft 70 to the operation of any one, or all of the tufting machine components to include the needle bar drive, shifting the needle bar, and the drive of the hooks/knives and/or loopers of the machine. This includes, by way of example and not by limitation, timing discs, followers, or indexing devices used to emit a position signal of main shaft 70 which is received by control processor 50. FIGS. 3A–3B illustrate the manner in which the precision drive system of this invention can be retrofit to an existing tufting machine having a main drive shaft 70 so that needle bar 13, or needle bars 13*a* and 13*b* in a dual shiftable tufting machine, is laterally shifted by one or two linear actuators 74, respectively, thus dispensing entirely with the known mechanical systems for actuating, i.e. laterally shifting, needle bar 13, or needle bars 13*a* and 13*b,* as in dual needle bar machines.

Actuator 74 is identical in function to actuators 16, 34, 46, and 63, and has an elongate actuator shaft 75 fastened to needle bar 13. The manner in which shaft 75 is fastened to needle bar 13 is illustrated generally in FIGS. 4–5B, and can be accomplished in known fashion by mechanically fastening shaft 75 to needle bar 13, needle bar 13 being supported in known fashion for being laterally shifted, i.e. being shifted transversely, with respect to backing material 11 being passed over the width of tufting machine 5C.

Control processor or computing system 50 or computing system shown in FIGS. 1–3B, and which may also be the computer illustrated in the patents to Taylor, et al., referenced above, is in electronic communication i.e., it is wired through control interfacing, to actuator 74, which also may include being connected to the actuator through a fiber optic network rather than control interfacing through wires. It is understood by those of skill in the art that the manner in which control processor 50 is in communication with actuator 74 applies equally to actuators 16, 34, 46, and 63 of FIGS. 1 and 2, respectively, as well as actuators 131 and 135 of FIGS. 6 and 10, respectively, so that they also can be hard wired through control interfacing or connected through a fiber optic network through control interfacing, as desired. As discussed herein, each of the illustrated tufting machines can be an entirely "shaftless" machine if so desired, that is without utilizing the main drive shaft of conventional tufting machines. Moreover, each of these actuators also can be separately mounted to a conventional tufting machine for controlling the respective drive systems of the machine on a retrofit basis, as illustrated in FIGS. 3A–3B, and FIGS. 6–10, for example. Also, and although reference is made to the digital control of the tufting machine by control processor 50, it is intended that control processor 50 may be formed as a part of, or work in conjunction with, an analog control system; or be a part of an analog-digital hybrid control system; or be an entirely digital, i.e. a feedback device and/or a software based control system. Accordingly, the precision drive system of this invention can be either, or both, an analog or digitally controlled machine.

By way of example, and not by limitation, each of actuators 16, 34, 46, 60, 74, 131, and/or 135 comprise that series of inverted roller screw actuators known as the GS series of linear actuators manufactured by Exlar Corporation of Chanhassen, Minn. Each of the family of Exlar GS series linear actuators uses an inverted roller screw, which is a mechanism for converting the rotary torque of a servo motor formed as a part of the actuator into a linear motion, in fashion similar to the use of an Acme screw or ball screw. However, unlike Acme or ball screws, roller screws are designed to carry heavy loads for extended periods under demanding conditions, and in conjunction with a servo motor, can do this through a precise range of travel without the shock loading, lag, or compression associated with hydraulic actuators. Each of the roller screws of each actuator may comprise multiple threaded helical rollers assembled into a planetary arrangement around a threaded main shaft, i.e. actuator shafts 17, 35, 47, 64, and/or 75, respectively, which convert the servo motor's rotary motion into linear movement of the shaft. Also, through the use of a planetary gear arrangement, these roller screws have much greater load carrying capabilities than ordinary Acme or ball screw arrangements. The Exlar series of GS series linear actuators allow rotational speeds of up to 5,000 rpm or higher, which translates into extremely high, and efficient, linear speeds. The Exlar linear actuators are disclosed in U.S. Pat. Nos. 5,491,372 and 5,557,154.

As schematically shown in FIGS. 3A–3B, control processor 50 comprises a computer that can read and execute computer programs stored on any suitable computer-readable medium for use in digitally and automatically controlling the tufting machine operation in accordance with a computer operating program or a pre-programmed data table, and, in this instance, also controlling the transverse, i.e. lateral, shifting of needle bar 13, or 13*a* and 13*b* in the case of dual shiftable needle bar machines. Control processor 50 is provided with a central processing unit; an input device, for example, a keyboard, mouse, or other data input device; an output device, for example a visual display similar in function to operator interface 99; an input/output adapter for uploading and downloading data and programming information from any suitable computer-readable medium; and an input/output adapter for receiving signals emitted from the position feedback device for each respective actuator, and for emitting return control signals to each respective actuator. Control processor 50 also is provided with additional input/output devices, as shown in FIGS. 3A–3B and 6A–11B.

Control processor 50 also is equipped with a memory, i.e. a computer-readable medium. The memory will store the operating system for the control processor, and any additional applications or programs used by the control processor, as well as a control program or programs for controlling each of the actuators of the precision drive system. Although not shown in detail in FIGS. 3A–3B, it is understood by those skilled in the art that the memory of control processor 50 can comprise a random access memory, and/or a read only memory which may be formed as a part thereof. In known fashion, each of the above-described components of the control processor communicates with one another through a data bus in conventional fashion.

The input/output adapter of control processor 50 is equipped to receive data as well as computer programming instructions from any one, or combination of, portable storage containers such as a magnetic floppy disc, to include a floppy disc drive; a magnetic hard disc drive; a magnetic digital tape, provided with a separate digital tape drive; memory cards, provided with a separate memory card reader/device; and/or a CD-ROM device having a separately provided CD-ROM reader. It is also anticipated that control processor 50 could be adapted to work with a DVD-CD system.

The input/output adapter of the control processor will include any necessary analog to digital, and digital to analog converters needed to process any analog data signals received, or to be emitted, from control processor 50 to other components of the tufting machine. It is understood by those skilled in the art that the memory of the control processor will hold computer programs comprised of blocks of executable programming code which form a part of the control program of the precision drive system, these blocks of executable code being input to the control processor through any one of the portable storage computer-readable mediums described hereinabove, and in communication with the control processor through the input/output adapter thereof. Control processor 50 can be an IBM PC compatible computer, although other suitable computing systems or other suitable operating systems could be used, such as RISC based devices.

The memory of control processor 50 will hold a pre-programmed "cam" profile for each one of the actuators or servo-motors forming a part of the precision drive system of the tufting machine. The camming profiles either can be part of a pre-programmed data table provided as a part of the control processor, or can be calculated by the control processor "on the fly" and in response to the signals emitted by each of the respective position feedback devices for each actuator, as well as in response to the instructions received from the operator interface 99. The electronic cam profiles for each of the respective actuators will be programmed for timing dependence on one another, and as appropriate for coordinating the control of the tufting machine. In this fashion, the operation of actuators 16, 34, 46, 63, 74, 131, and/or 135 allows for a broad range of operating parameters and conditions, as well as a broad range of timed relationships of the movements of the components of the tufting machine with respect to one another, as well as control of yarn feed and backing material feed. Control processor 50 may be provided for each separate tufting machine, i.e. one control processor for each of a number of tufting machines, or control processor 50 can be part of a networked control system in which a centralized control processor communicates with remote control processors 50 positioned on each respective tufting machine, or formed as a part thereof, for operating the machines in relationship to one another, as well as operating the components of each machine individually and in timed relationship with respect to one another.

As shown in FIGS. 3A–3B, after being informed by position feedback device 76 of the rotational position of the servo-motor of actuator 74, which is translated in this instance to a linear position of the actuator's shaft 75 engaged with needle bar 13, or 13*a* and 13*b* as the case may be, control processor 50 emits a desired position signal from memory to a positional computational unit 80 which may be formed as a part thereof. Unit 80 emits either a digital or analog control signal, here an analog signal, to drive 81, then to the servo motor formed as a part of actuator 74. In response to the rotational movement of actuator 74, equating to the linear movement of shaft 75 and thus the transverse shifting of needle bar 13, or 13*a* and 13*b*, position feedback device 76 emits a position signal, or feedback signal, to drive 81 as well as to positional computational unit 80 so that drive 81 may loop on itself to accurately control its position. Unit 80 in turn passes this information on to control processor 50 in which the control program for this system receives the data, and monitors the motion of actuator 74, and/or controls the motion of actuator 74, when and as desired, and in accordance with the control program and instructions being acted upon by the control processor. Actuator 74 also may be coupled to a linear feedback conversion unit 82 which would report the linear position of shaft 75, and thus the shifting of needle bar 13, or 13*a* and 13*b*, to control processor 50 if desired. Also, if so desired, encoder 76 could be replaced by a linear transducer which measures linear displacement, and could be either an internal or an external device mounted on the machine with respect to the needle bar. Also, where an encoder or any other type of feedback device is shown in the drawings, or described within the specification, for use with any component of the tufting machine described above or below, it is anticipated that such feedback devices would encompass not only encoders, but also resolvers and/or linear transducers.

Control processor 50 also receives data from a proximity switch 83, if provided, positioned on the frame with respect to the needle bar for monitoring the position of the needle bar with respect to the frame, as appropriate, and also may be provided with an optional limit switch 84 hard wired to actuator 74 and/or actuator shaft 75, and to control processor 50. Limit switch 84 also may comprise a programmable (software-based) limit switch formed as a part of the control program housed, and executed, by control processor 50.

A relay 85 provides a delay, for example, of one second, in machine shutdown in the event that the actuator is running over temperature as reported by pressure lubrication system 86. Pressure lubrication system 86 is provided to lubricate and cool actuator 74, and includes an oil pump 88, a pressure piping system 89, and an oil filter 90. Although oil pump 88 could operate continuously, it is anticipated that oil pump 88 need only run when the respective actuator servo motor corresponding to that pressure lubrication system is being used. Pressure lubrication system 86 also includes an oil pressure regulator 92 for controlling, and reporting, the oil pressure used to cool actuator 74. Thus, in the event the oil pressure of pressure lubrication system 86 falls too low or rises too high, or the oil temperature rises too high, a temperature sensor (not illustrated) provided as a part of the system 86, emits an over-temperature sensor signal to control processor 50, to shut down actuator 74 before it becomes damaged in the event that it is not being sufficiently lubricated.

Both control processor 50 and pressure lubrication system 86 are provided with electrical power from a power source 94, illustrated schematically in FIGS. 3A–3B. For control processor 50, the electrical power to power supply 94 is monitored by a power monitor 95, which emits a power monitor control signal to control processor 50 indicating a sufficient power level is present to operate the drive system. A bus voltage monitor 96 is tied into power supply 94, as well as the power being supplied to drive 81, to monitor voltage levels, and to monitor for power line spiking, or power variances either between the power supply or the drive, or within the drive of the actuator. Control processor 50 is provided with a relay 98 which closes when the system is ready to run, and will emit a ready signal to operator interface 99, at which point the operator can start operation of the precision drive system. Operator interface 99 may include, for example, a touch-sensitive screen on which a series of menu options is available, much in the fashion described in the patents to Taylor, et al., referenced above.

FIGS. 3A–3B illustrate the use of the precision drive system of this invention to control and power (drive) the shifting of needle bar 13, or needle bars 13*a* and 13*b* as the case may be, during tufting operations, while being used on an otherwise conventional tufting machine on a retrofit basis, for example. In this instance, the absolute position sensor assembly 101, and the rotary feedback assembly 102 would be provided so that control processor 50 could time the operation of actuator 74 in relationship to the rotation of shaft 70. In such conventional tufting machines, shaft 70 may include either eccentric cams, push rods, or eccentric crank mechanisms powered by belts or chains, for reciprocating the needle bar toward and away from backing material 11. In this manner, a closed digital loop over the control of the tufting machine main shaft is possible, although conventional AC or DC motors may be used to rotate the main shaft of the tufting machine.

Accordingly, absolute position sensor assembly 101 could include a magnet 104 mounted on disk 78, and a position sensor 105, a proximity switch or other known type of sensing device. Rotary feedback assembly 102 is provided with at least one, and in this instance, two, encoders 107, 109 which are driven off of shaft 70 by a flexible timing belt or chain to provide a control signal of the position of shaft 70, this data being used by the control processor to interpret the position of needles 12 (FIGS. 1, 2) with respect to backing material 11, and thus the degree with which needle bar 13 will be laterally shifted as described in U.S. Pat. Nos. 4,440,102 and 5,224,434 to Card, et al., respectively. As known in the art and discussed above, various systems can be used to determine when the needles are out of the backing material to permit needle bar shifting. Further, known systems can determine needle position at any point in their reciprocation, such as just prior to exiting the backing material, to assist in needle bar shifting.

That portion of the control schematic of FIGS. 3A–3B comprising control processor 50, positional computational unit 80, drive 81, linear feed limit conversion unit 82 (if provided), limit switch 84 (if provided), pressure lubrication system 86, power supply 94, power monitor 95, bus voltage monitor 96, relay 98, and operator interface 99 also will be provided for operating actuators 16, 34, 46, 60, 131, and/or 135 (FIGS. 6A–10B) in the event that tufting machines 5A and 5B, for example, as shown in FIGS. 1 and 2 respectively, do not use a rotating tufting machine main shaft 70 as shown in FIGS. 3A–3B. Therefore, and as shown in FIGS. 3A–3B and 6A–10B, control processor 50 is adapted to control each individual precision drive system component, or all components together when provided on a "shaftless" machine as described above, for operating the machine. Control processor 50 will communicate with a positional computational unit 80 in each instance which may be one functional unit or assembly, the positional computational unit communicating with a separate drive 81 for each of the actuators 16, 34, 46, 60, 74, 131, and 135, respectively. Each of the actuators include a position feedback device in communication with the drive, the drive then communicating with the positional computational unit, and then back to the control processor, where the control signals are acted upon by the computer program stored within the control processor, and are used to operate any one of tufting machines 5A–5H shown in FIGS. 1–10.

For example, and as indicated generally in FIGS. 7A–7B and 11A–11B, in a "shaftless" tufting machine 5E (FIG. 7B) and 51 (FIG. 11B), linear actuators will be used to move each of the principal operational elements of the tufting machine separately, yet each linear actuator will move the machine elements in timed relationship with one another through control processor 50. This unique design, therefore, provides for separate linear actuators, and/or servo motors in conjunction with more conventional drive trains, if desired, for reciprocating needle bar 13, or needle bars 13*a* and 13*b* as the case may be, for rocking looper/hook drive shafts 31, 60, respectively, for rocking knife drive shaft 43, for positioning bedrail 9 (FIGS. 10A–10B), and for activating the backing or jute shifter device 130 (FIGS. 6A–6B) for transversely shifting the backing material with respect to the needles and loopers, without having to shift the needles, when, and if desired, although needle bar shifting, as discussed above, is an additional option with the system of the present invention. Each of these respective actuators is provided with a separate pressure lubrication system to ensure that the actuator remains lubricated and cooled. Moreover, in this case, control processor 50 is now adapted to control each one of the actuators independently of the other, but yet in timed relationship with one another, so that an exact and consistently repeated pattern of movement is maintained by the components of the tufting machine with respect to one another in that there are no mechanical interlinkages or other devices which will wear and thus alter the timing of the elements of the machine with respect to one another.

Figure 11A:
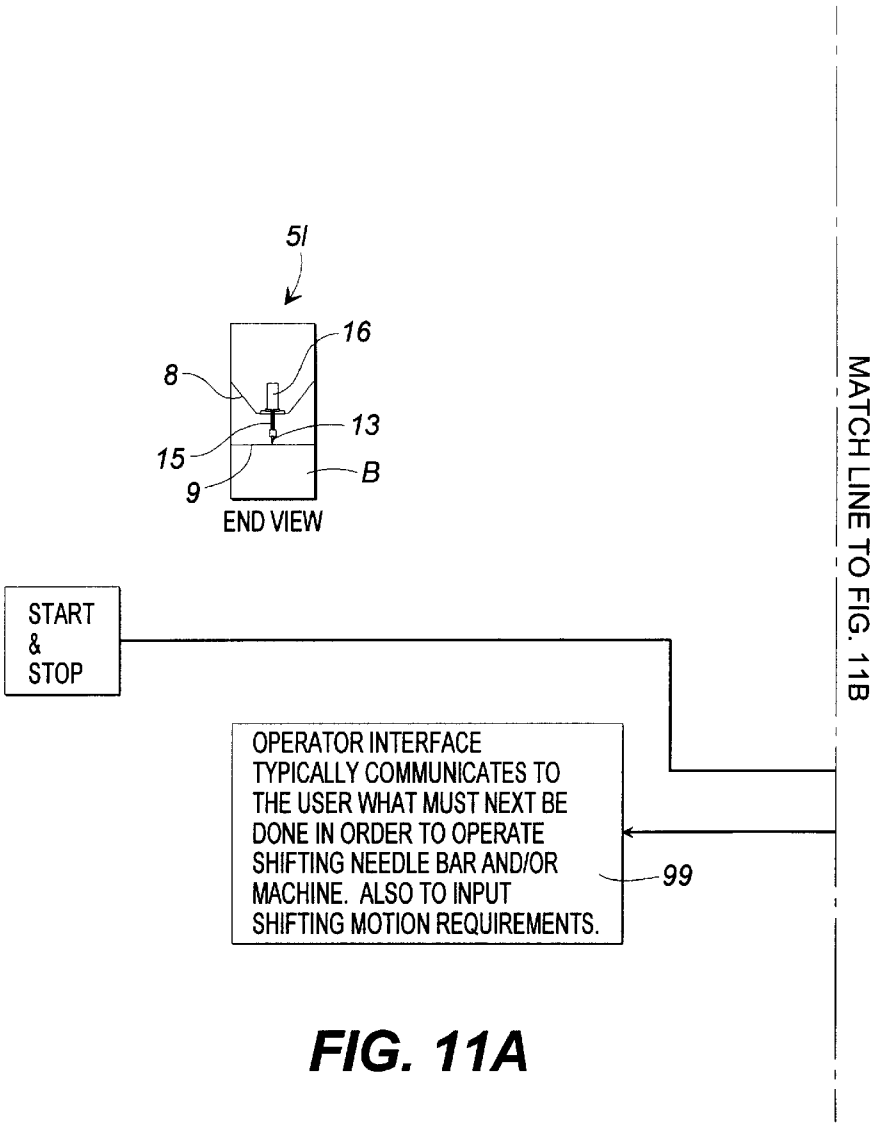
FIG. 11 is a schematic illustration of the precision control system of the invention used on a "shaftless" tufting machine for reciprocating the needle bar toward and away from the tufting zone of the machine.
Figure 11B:
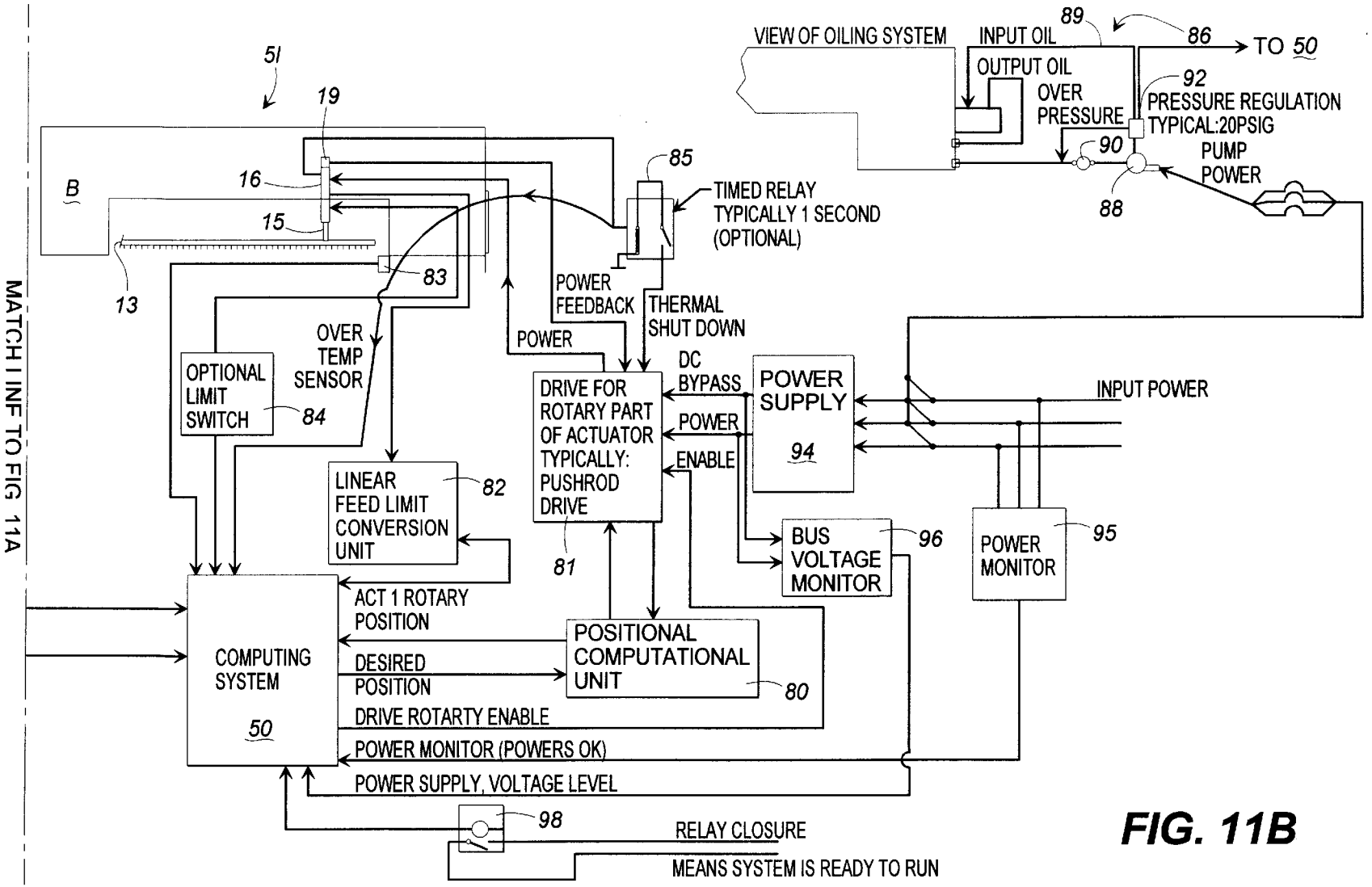

FIGS. 11A–11B illustrate a tufting machine in which each separate component of the tufting machine described hereinabove, is operated by a linear actuator, each of which is in communication with control processor 50 in the manner described above. Through operator interface 99, in conjunction with the computer program executed by control processor 50, as well as utilizing any pre-programmed data parameters stored within the control processor, each individual element of the tufting machine can be phased, or have a position related, with respect to the position of the needle bar and the needles thereon, with respect to the backing material, loopers, and/or hooks, and each of these components can be adjusted separately when, and if, pattern changes for example, or other desired variances in the system are programmed to occur, or made to occur manually through operator interface 99, in conjunction with a menu-driven system such as that disclosed in the patents to Taylor, et al. In this instance, a single control processor 50 would control each of the actuators, and thus relate to each of their respective positional computational units, drives, as well as limit switches or conversion units, and pressure lubrication systems, as appropriate.

Figure 6A:
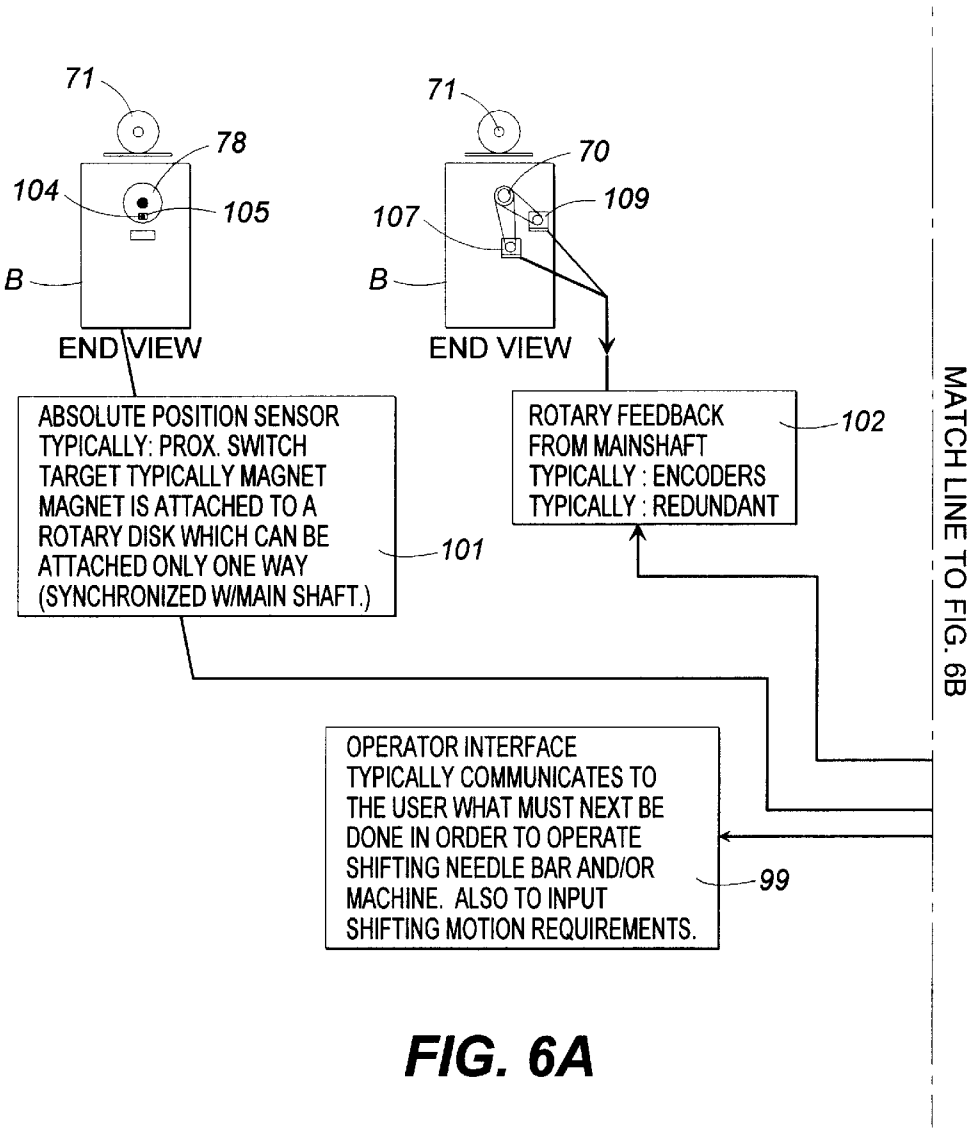
FIG. 6 is a schematic illustration of the precision control system of the invention used with a backing material shifter device.
Figure 6B:
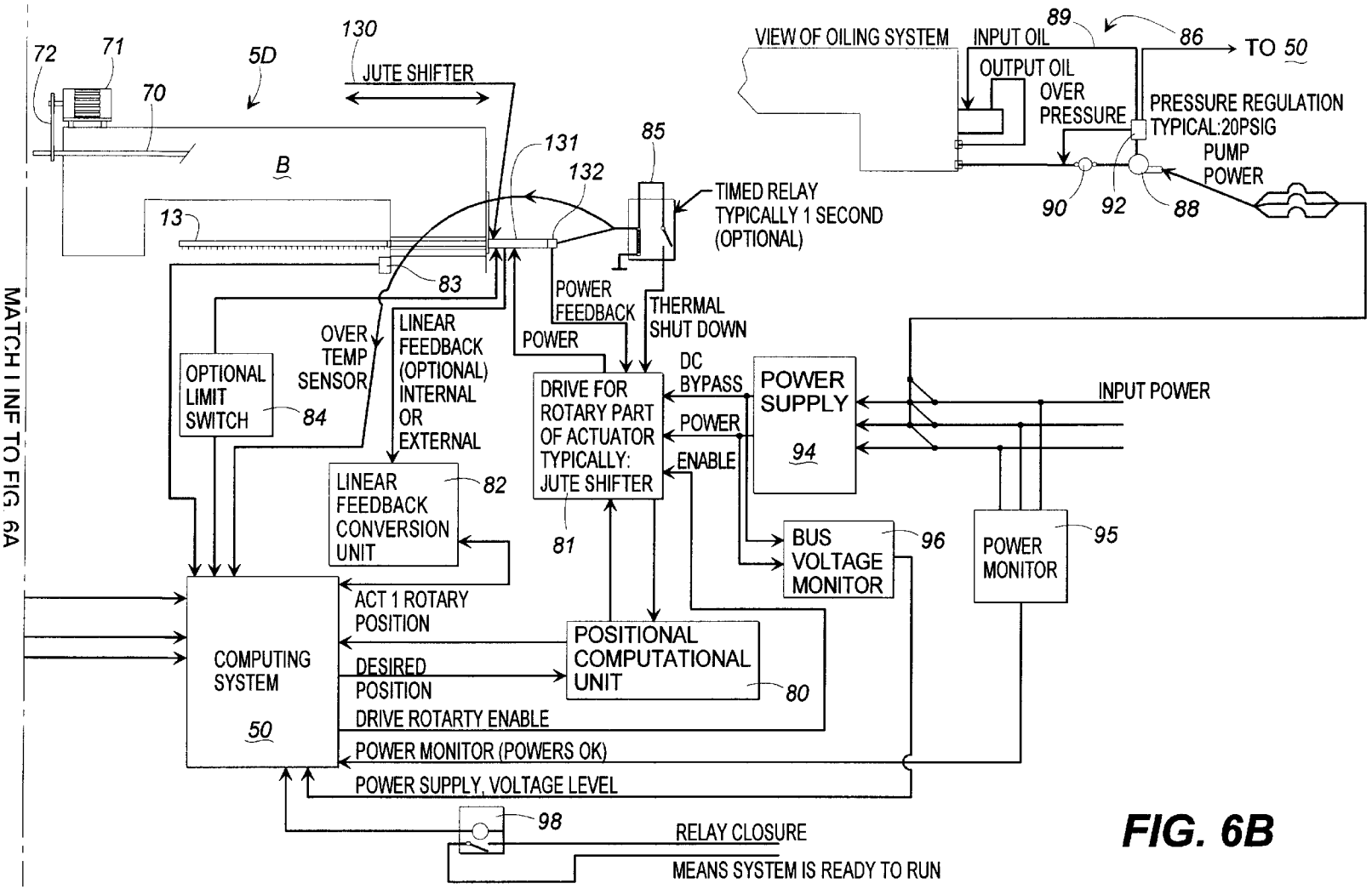

An alternative to using a transversely shiftable needle bar 13, is to provide a transverse spike roll, or a series of spiked rolls, referred to as a jute or backing shifter device 130 in FIGS. 6A–6B for tufting machine 5D, positioned beneath the backing material passing underneath the needle bar, such that the spiked rolls are actuated, in this instance by actuator 131, so that the backing material is transversely shifted with respect to the needles and loopers, rather than shifting the needles with respect to the backing material. In this fashion, the linear rows of the tufts in the backing material can be broken up, as well as allowing for control of stitch placement in fashion similar to shifting the needle bar with respect to the backing material. Actuator 131 is equipped with a position feedback device 132 in electronic communication with control processor 50 in the same manner as that in which control processor 50 is in communication with actuator 74 illustrated in FIGS. 3A–3B.

Figure 4:
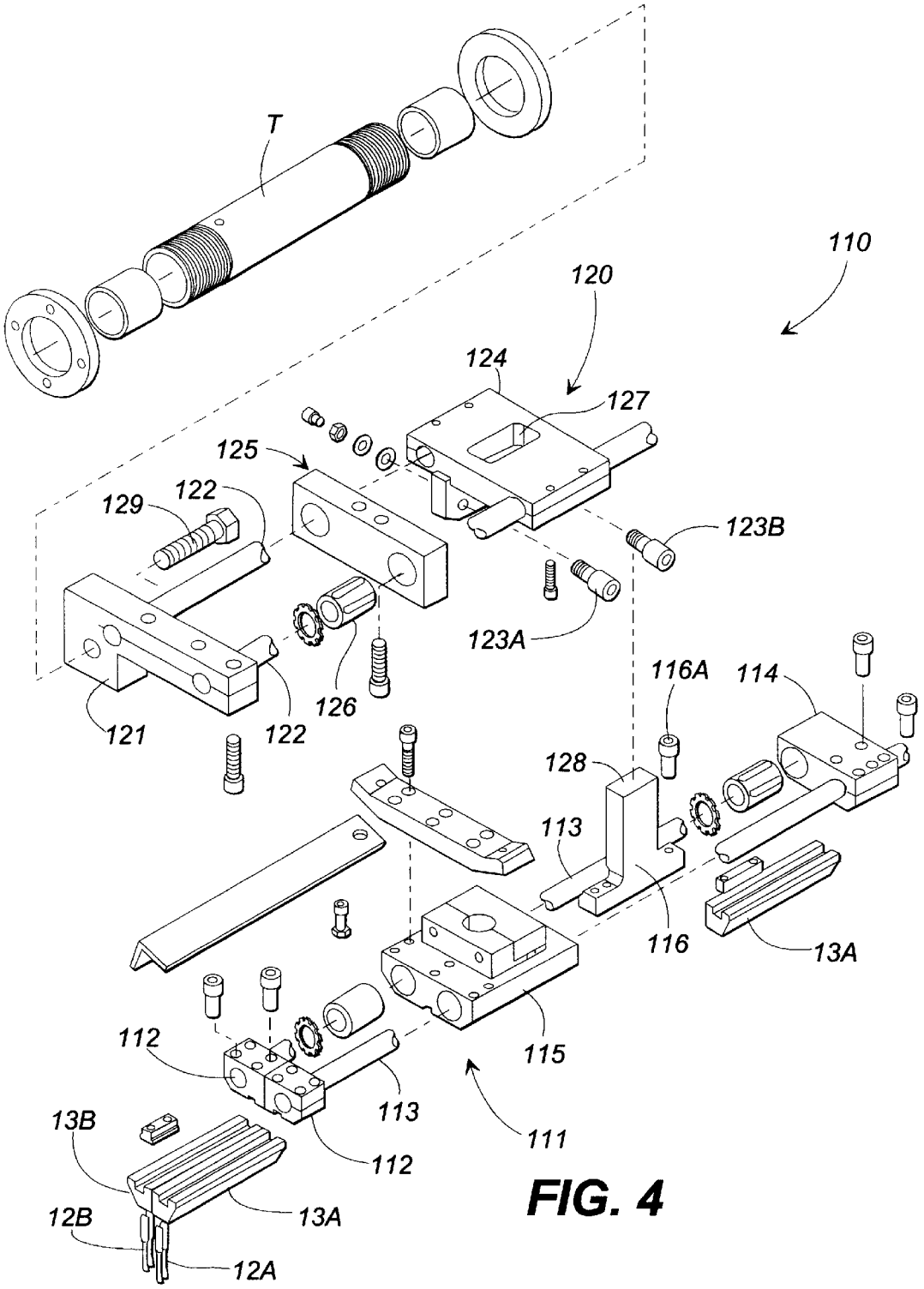
FIG. 4 is an exploded perspective view of a portion of the needle bar shifting assembly of the invention.
Figure 5A:
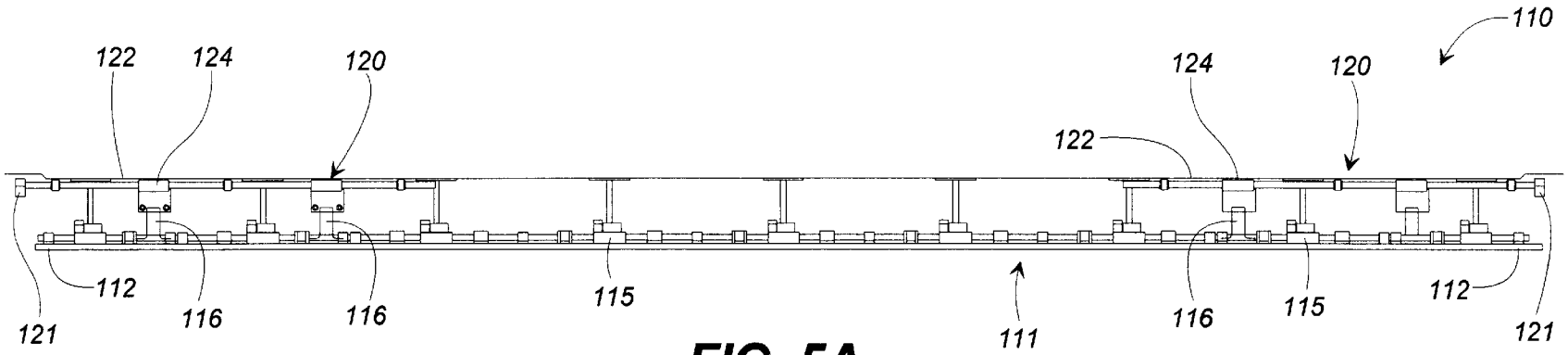
FIG. 5A is a front elevational view of the needle bar shifting assembly of the invention.
Figure 5B:
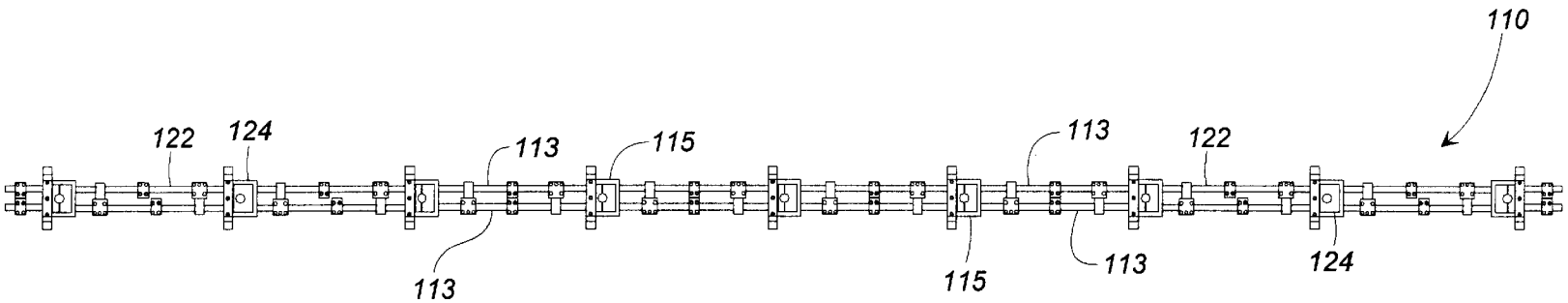
FIG. 5B is a top plan view of the needle bar shifting assembly of FIG. 5A.

The needle bar shifting assembly 110 used for supporting needle bar 13 in FIGS. 3A–3B for transverse movement is illustrated more fully in FIGS. 4–5B. Such shifting assemblies are well known in the art. In FIG. 4 two needle bars 13*a*, 13*b* are illustrated, each of which extends laterally with respect to the backing material 11 (FIGS. 1, 2) which moves from the front to the rear of the tufting machine. Actuator rod 75 is operably fastened to needle bar shifting assembly 110 by using a threaded coupling, or other conventional fastener at the end of the actuator rod 75 operably engaged to the needle bar shifting assembly 110. This specific fastening detail is not illustrated in FIG. 4, as this is well within the knowledge of those skilled in the art.

Needle bar shifting assembly 110 is comprised of a carriage assembly 111, and a slide assembly 120. A needle bar shifting assembly is provided for each needle bar, as known in the art. If two shifting needle bar assemblies are used, each assembly will have a separate linear actuator 74, the two linear actuators being controlled jointly by the above-described control system schematically illustrated in FIGS. 3A–3B. The carriage assembly includes a pair of end clamps 112 fastened to respective ones of a pair of spaced, parallel and elongate rods 113 which extend along the width of the tufting zone of the tufting machine as illustrated in FIGS. 5A and 5B. This apparatus could, for example, be fitted to tufting machines 5A and 5B of FIGS. 1 and 2, if so desired. Spaced along the length of rods 113 are a series of intermediate clamps 114, with the other of the ends of rods 113 being received in a corresponding pair of end clamps 112 (FIG. 5A). The end clamps, and intermediate clamps, hold rods 113 in a fixed spatial relationship with respect to one another. As shown in FIG. 4, each one of end clamps 112 has a profile machined therein for being received within a corresponding groove defined in each one of the two needle bars 13*a*, 13*b*, respectively. End clamps 112 can be mounted to the needle bars, such that the carriage assembly 11 forms a rigid structural body attached to the rigid needle bars of the tufting machine. Spaced along the length of rods 113, intermediate end clamps 112, as well as being intermediate clamps 114, are a plurality of bases 115 which are mounted to the push rods which reciprocate the needle bars 13*a*, 13*b* toward and away from the backing material. A spaced series of hardened slides or connectors 116 are fastened to the needle bars 13*a*, 13*b* by fastener 116*a* and extend upwardly and toward one of the slide assemblies 120.

Slide assembly 120 includes end clamp 121 which clamps a pair of spaced, parallel and elongate slide rods 122 for holding the rods in fixed position with respect to one another, the rods extending in the direction of the width of the tufting machine as illustrated generally in FIGS. 5A and 5B. As is known in the art, a tube T extends through head 8 of frame F, and includes bearings (not shown) which slidably engage shaft 75, not shown in FIG. 4. The end of shaft 75 will abut end clamp 121 and be held to clamp 121 by bolt 129. Spaced along the length of rods 122, and positioned in substantial registry with each one of connectors or slides 116 which are spaced along the carriage assembly, are a series of upper bases or cam follower supports 124 which are mounted to slide rods 122. The slide rods are slidably moved through one of a spaced series of bearing assemblies 125 mounted to the underside of head 8 (FIG. 1), and containing linear bearings 126. The slide assembly 120, and particularly slide rods 122, will slide through respective ones of the spaced bearing assemblies 125. When the distal end 128 of connecting piece or slide 116 is received between rollers 123A and 123B attached to upper base 124, the transverse movement of upper base 124 in concert with the sliding movement of slide rods 122 will result in a lateral or transverse motion of the carriage assembly 111, and thus the needle bars 13*a*, 13*b*, with respect to the backing material. When needle bar 13*a* or needle bar 13*b* is in the upper extent of its reciprocation, end 128 of slide 116 may extend into slot 127 defined in cam follower support 124.

The needle bar shifting assembly is illustrated in FIGS. 5A and 5B, showing a front elevation and top plan view, respectively, and shows the spacing of the bases 115 of the carriage assembly 111 along the width of the tufting machine, with connectors 116 being operably fastened to needle bars 13*a,* 13*b.* Although not illustrated in FIGS. 4 and 5A–5B, an actuator 74 is operably fastened to each slide assembly 120 (FIG. 4) for transversely shifting the needle bar shifting assembly in response to signals emitted by control processor 50. Additionally, separate pairs of actuators 74 can be provided for each one of needle bars 13*a,* 13*b,* respectively, if desired.

Figure 7A:
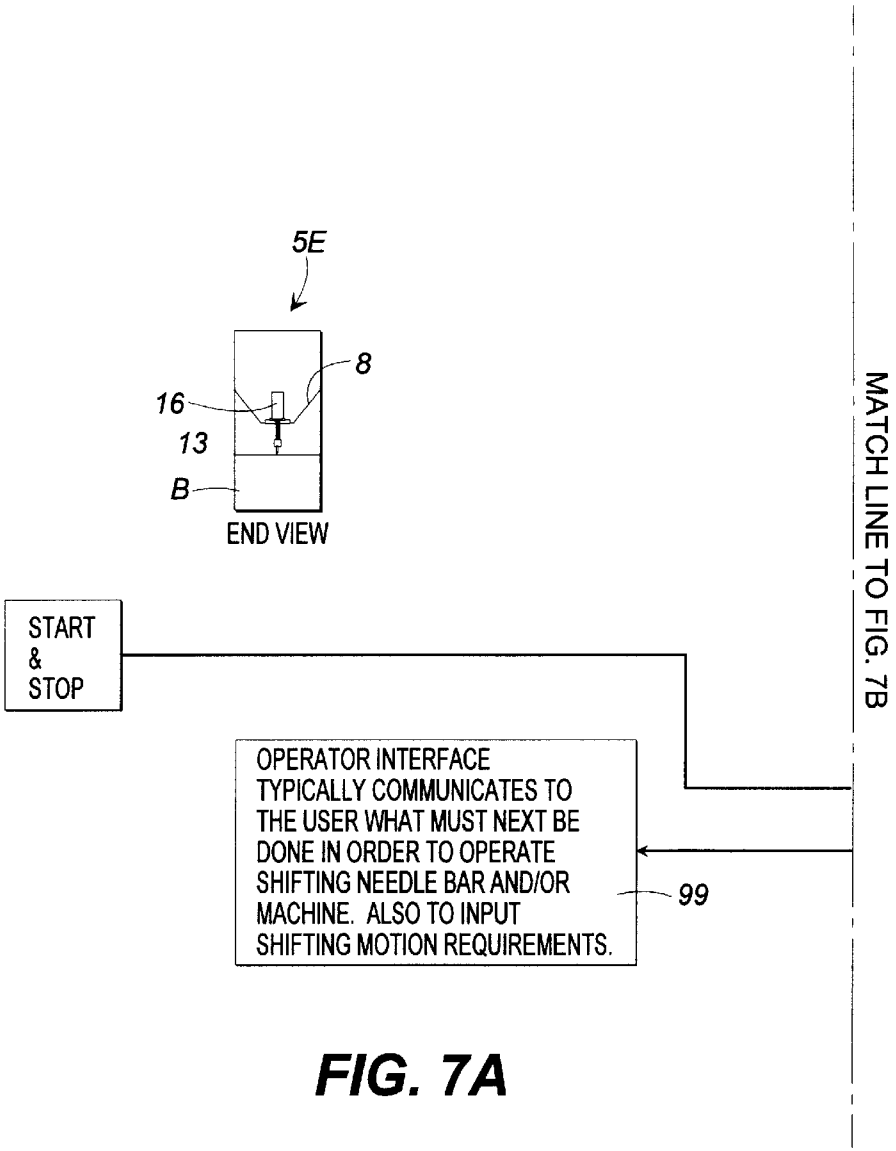
FIG. 7 is a are schematic illustration of the precision control system of the invention used to reciprocably drive a needle bar.
Figure 7B:
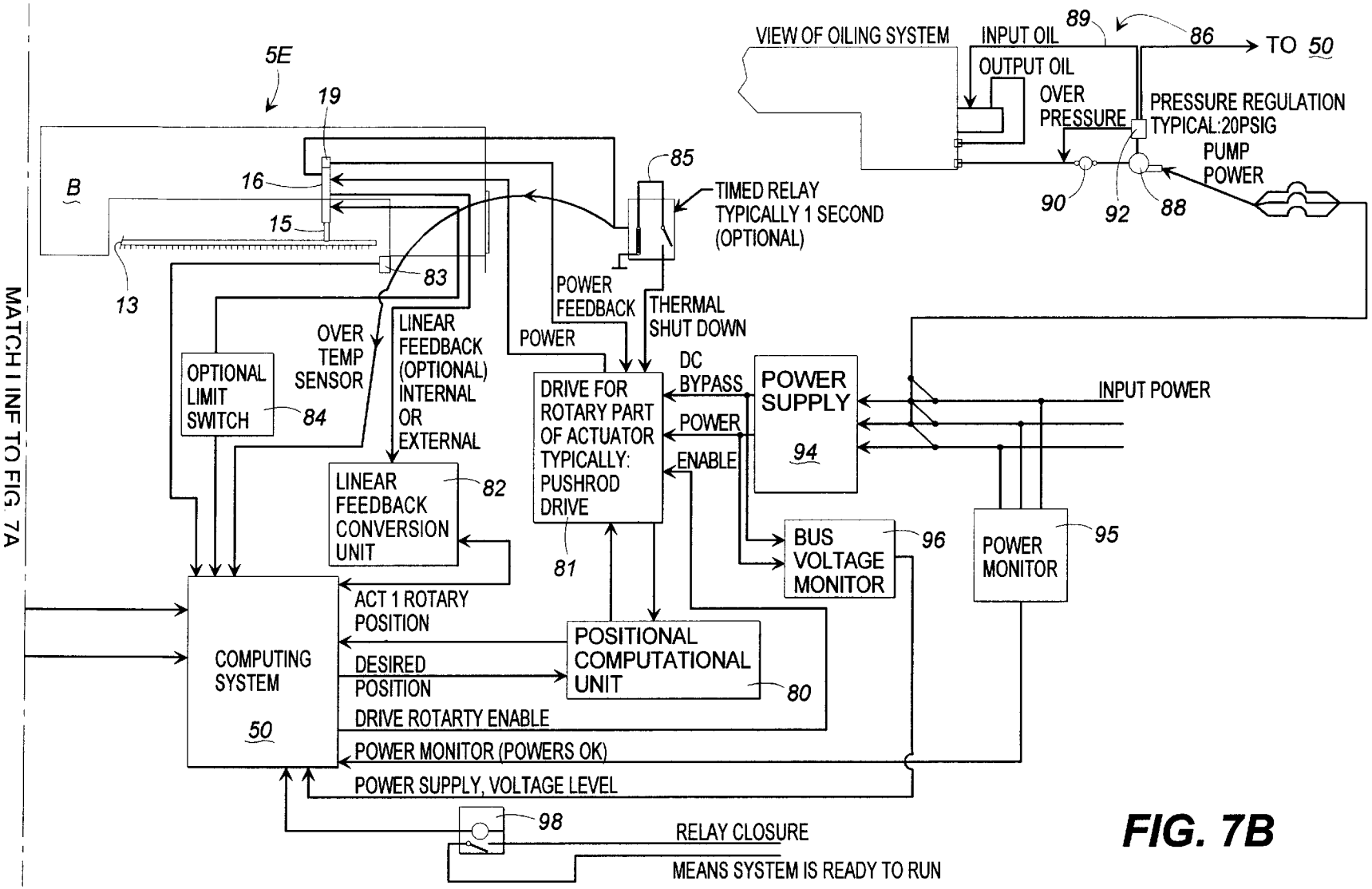

A "shaftless" tufting machine 5E is illustrated in FIGS. 7A–7B, in which at least one actuator 16, and more preferably a spaced series of actuators 16, are used to reciprocate needle bar 13 toward and away from the backing material during tufting operations. As seen in the control schematic of FIGS. 7A–7B, the same control scheme is used here, as it is in FIGS. 3, and 8–10, for each of the drive systems and the components thereof that comprise the precision drive system of this invention. As tufting machine 5E does not have a tufting machine main drive shaft 70 (FIGS. 3A–3B), there is no need for absolute position sensor assembly 101, nor rotary feedback assembly 102, as position feedback device(s) 19 will allow for the precise tracking of the position of the needle bar 13 with respect to the remaining components of the system, as well as allowing the remaining components of the system to be timed in relationship to the reciprocation of the needles through the backing material 11 (FIGS. 1, 2).

Figure 8A:
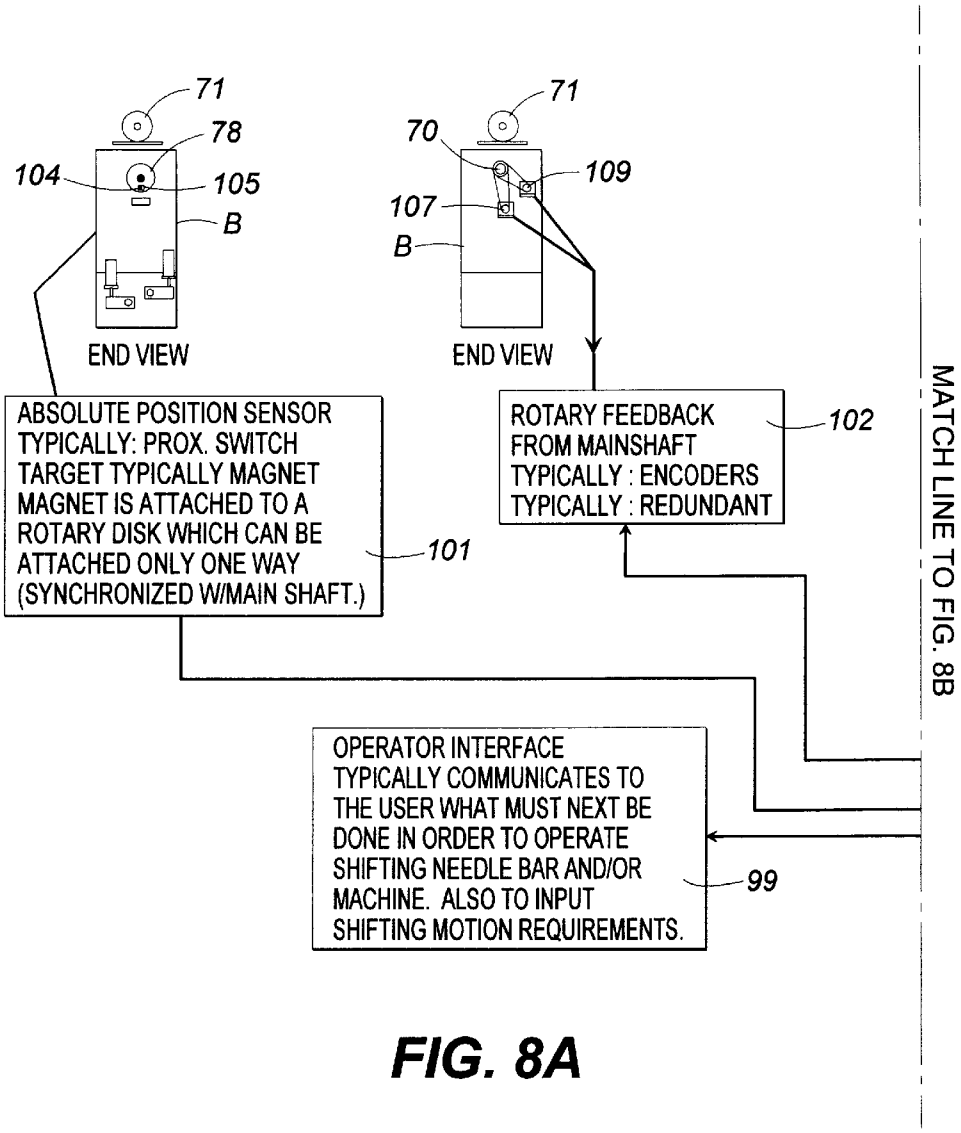
FIG. 8 is a schematic illustration of the precision control system of the invention used to rock the hook and knife drive shafts of a cut pile tufting machine.
Figure 8B:
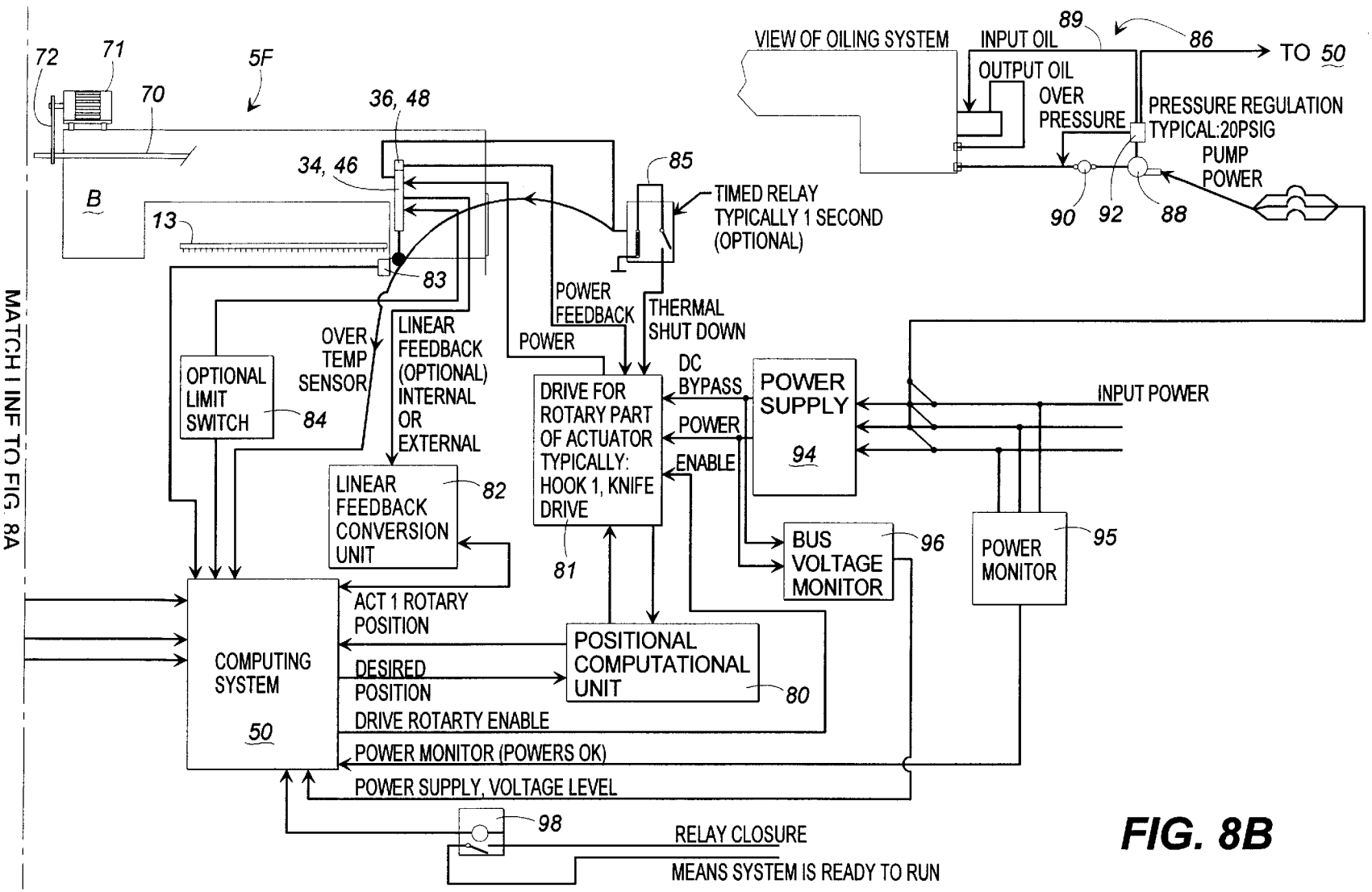

Tufting machine 5F of FIGS. 8A–8B discloses a linear actuator 34, 46 with respective feedback devices 36, 48 for rocking hook/looper drive shaft 31, and knife drive shaft 43, of the cut pile tufting machine of FIG. 1. Rather than providing two separate actuators as is shown in FIG. 1, in FIGS. 8A–8B a single actuator is used to rock both the hook and knife drive shafts in relationship with one another, as well as being rocked in timed relationship with the reciprocation of needle bar 13. If desired, a first actuator 34 and a separate second actuator 46 can be provided, as shown in FIG. 1, although the arrangement of FIGS. 8A–8B allow for the same precise control of the loopers (hooks) and knives of the tufting machine with respect to the needle bar using only a single actuator. Otherwise, the control schematic of FIGS. 8A–8B for the hook and knife drives is the same as that for the components of the precision drive system illustrated in FIGS. 3A–3B, 6A–6B, and 9A–10B.

Figure 9A:
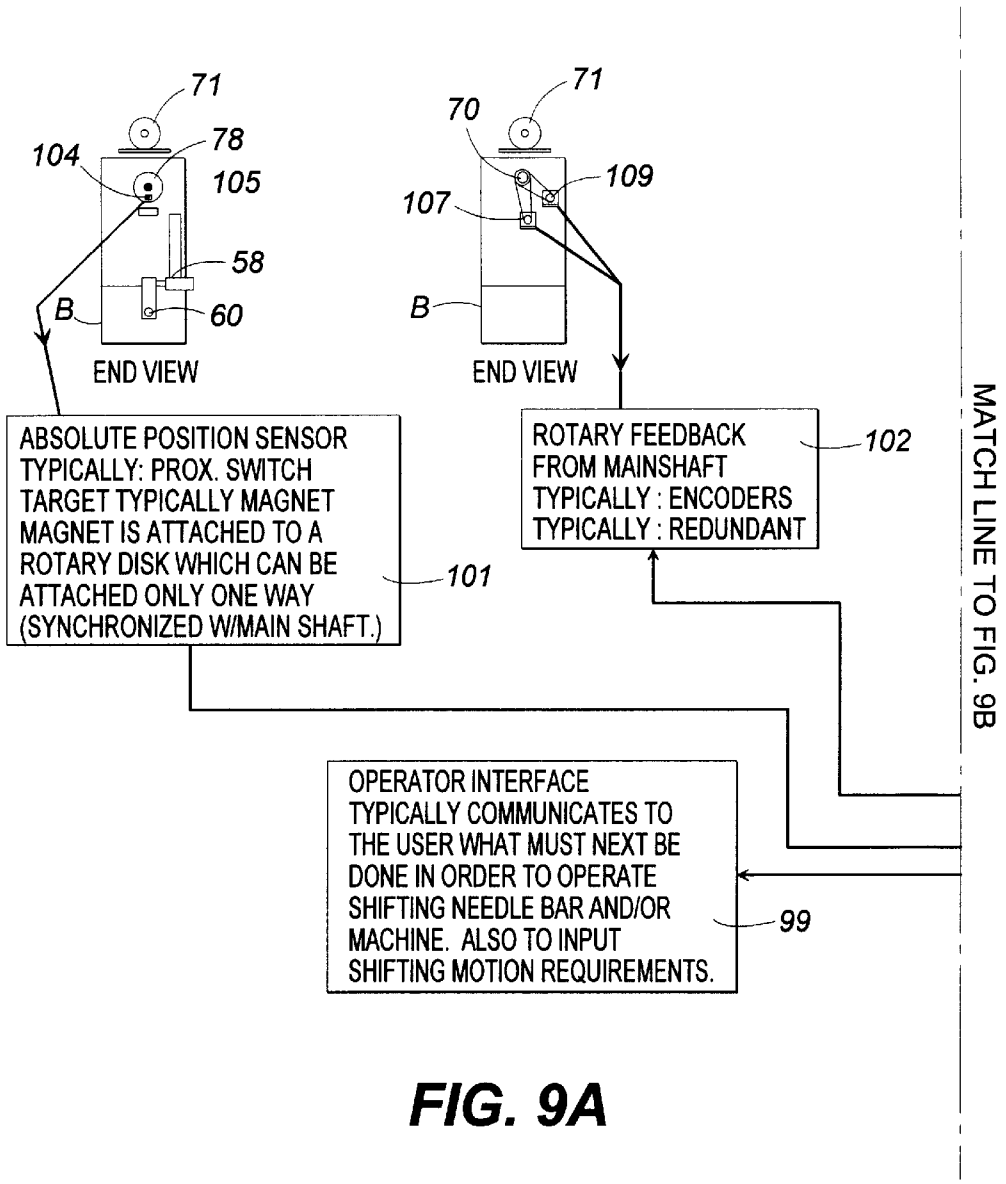
FIG. 9 is a schematic illustration of the precision control system of the invention used to rock the looper drive shaft of a looped pile tufting machine.
Figure 9B:
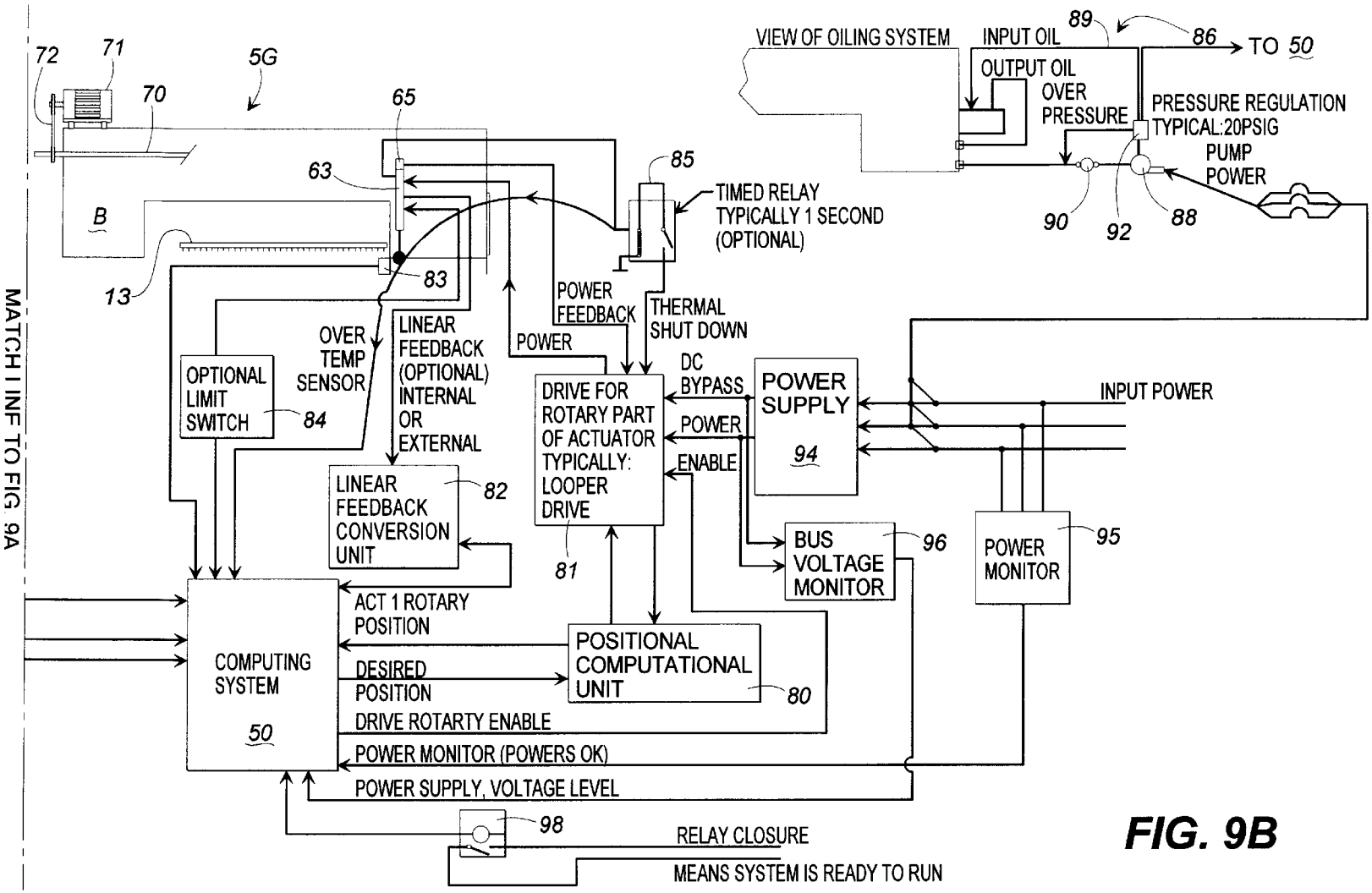
Figure 10A:
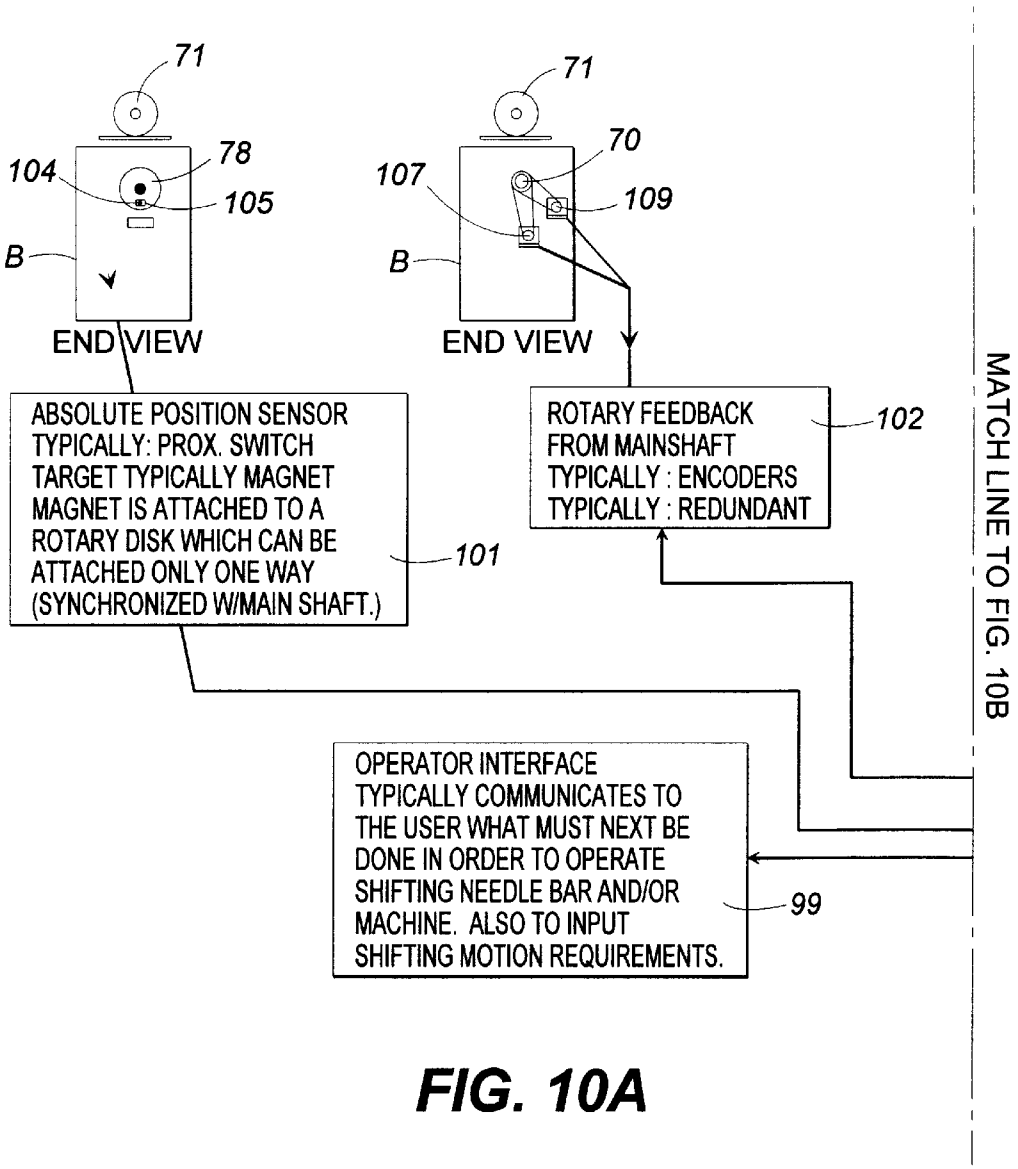
FIG. 10 is a schematic illustration of the precision control system of the invention used with a bedrail adjustment device.
Figure 10B:
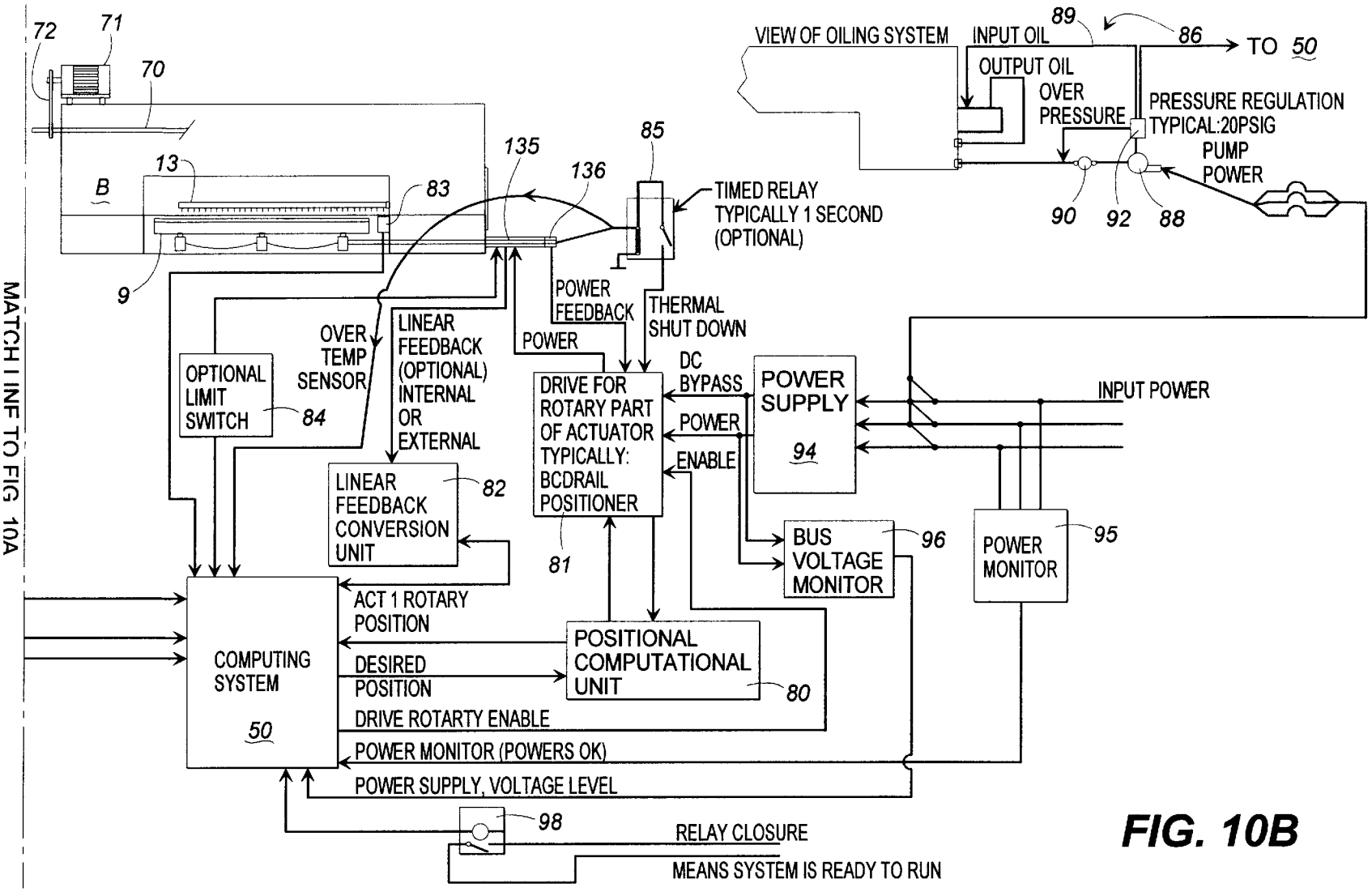

Tufting machine 5G of FIGS. 9A–9B is provided with a linear actuator 63 for rocking looper drive shaft 60 (FIG. 2) for a looped pile tufting machine. Accordingly, position feedback device 65 of the actuator is in communication with control processor 50, in the same fashion as is shown in FIGS. 3A–3B, 6A–8B, and 10A–10B. Tufting machine 5H of FIGS. 10A–10B discloses a linear actuator 135 used to vertically adjust the position of bedrail 9, with respect to needle bar 13, as well as with respect to the loopers (not illustrated), and hooks (not illustrated) based on the height of the looped or cut pile to be produced during tufting operations, in known fashion. Actuator 135 has a position feedback device 136 in communication with control processor 50 utilizing the same control scheme illustrated in FIGS. 3A–3B, and 6A–9B, and is operated in the same manner. Although FIG. 10B depicts actuator 135 in a horizontal orientation, it is understood that this figure is a schematic representation, only, and that the tufting machine of the present invention, the specific embodiment disclosed will have the actuator oriented vertically, under the bedrail.

Each one of actuators 16, 34, 46, 63, 74, 131, and 135, as well as any additional actuators or servo-motors used on the tufting machine, may be programmed to advance, dwell, or retard their operation, as desired, without any mechanical gear changes or similar adjustment, resulting in flexibility in machine operation.

Another unique feature of this improved tufting machine is the manner in which the needle bar, or bars, will be "homed," which is finding the absolute position for the needle bar prior to being laterally shifted, and is performed to calibrate the tufting machine, and particularly the respective positions of the needles and needle bars with respect to the backing material and the tufting zone. The software code for accomplishing this homing of the needle bar(s) is disclosed in the attached Appendix.

The homing sequence, therefore, as implemented with the use of proximity switches 83 (FIGS. 3A–3B) and index marks as the primary devices for finding the home position of the needle bar, thus includes the steps of turning the main power for the machine on, whereupon the machine controller or computer initializes itself to a known state. Information which has been previously recorded about the characteristics and measurements of each needle bar is recalled from a permanent memory, a ROM or hard drive for example, into the working memory of the computer, for example the RAM. The needles are verified to be "out of the backing" by using a proximity switch, or other feedback device as described and illustrated herein, mounted such that it activates when the needles are at or near the top of their travel, meaning that they are out of the primary backing material.

The control program of the needle bars is then enabled, i.e. the power is applied so that motion is now possible. The machine operator is then asked in a message on interface 99 to acknowledge that the next sequence will cause motion on the machine (i.e. the needle bars could begin moving). The computer then determines the number of steps, or lateral shifts measured by a predetermined gauge distance, and the location of the needle bar to which each inverse roller screw actuator, or other servo drive mechanism capable of laterally shifting the respective needle bars, is attached, for example the front needle bar or the rear needle bar. The number of motor feedback units required when the motor moves an exact distance (e.g. 1 inch) is then calculated.

An offset is calculated in motor feedback units, which corresponds to the distance (and direction) of travel required to be moved before proceeding with searching for the "motor index mark," which typically would activate once per revolution and at the same physical location of the motor's internal rotational position. An offset is then calculated in motor feedback units, which corresponds to the distance (and direction) of travel required to be moved after the "motor index mark" is recorded. This final position calculation is termed the home position. A distance (which is typically very small, e.g. 0.015") is then calculated in terms of motor feedback units. This distance is recorded such that if the motor is "jammed" or otherwise prevented from moving by an amount (motor feedback units) greater than calculated, then the system will shut down so as to prevent damaging the machine (i.e. breaking machine gauge parts during the homing of the needle bar).

The proximity switch of the needle bar is set up so that the switch will be "OFF" at any point while the needle bar is to the "left of the center of travel," and that the switch will be "ON" at any point while the needle bar is to the "right of the center of travel." The initial direction of motion is determined by the state of the proximity switch mounted on the needle bar. By the above description of the proximity switch mounting, if the switch was "ON" then it could be determined that the needle bar was located somewhere to the right of center of travel, and thus the needle bar would need to be moved toward the left so as to approach the center of travel of the needle bar.

The needle bar is moved back and forth several times. Each time the proximity switch changes state, the current position of the system is recorded. All of the recorded positions of the transitions of the proximity switch are then averaged so as to determine an accurate position of the proximity switch's transition point. This indicates the center of travel of the needle bar, but only to the accuracy of the mounting location of the proximity switch. The needle bar is then moved a relative distance which was predetermined from long term storage memory.

The needle bar is then moved back and forth a predetermined distance while recording the positions at which the "motor index mark" was seen. The index mark positions are then error checked against each other, and should agree with each other to a very high resolution as compared to the resolution of the motor's rotation. The index mark positions are then averaged together to obtain a repeatable and known location of the needle bar, since some of the marks were recorded as approaching from the clockwise direction, and the other marks would have been recorded as approaching from the counterclockwise direction. The system is then moved a distance which was recalled from long term memory. This location is the "home position. All motion for the rest of the machine's operation will be in relationship to this known location.

The homing sequence, as implemented with the use of a linear transducer as the primary device for finding the absolute, the home, position of the needle bar includes the steps of turning the main power of the machine on, whereupon the computational unit initializes itself to a known state. Information which has been previously recorded about the characteristics and measurements of each needle bar is then recalled from permanent memory into working memory. The needles are verified to be "out of the backing" by use of a proximity switch mounted such that it activates when the needles are at or near the top of their travel, meaning the needles are out of the primary backing material. The system is then enabled, and power is applied so that motion is now possible.

The operator is then asked in a message on interface 99 to acknowledge that the next sequence will cause motion on the machine, i.e. the needle bars could begin moving. The computational unit then determines the number of actuators and the location of the needle bar to which each is attached, for example the front or rear needle bars. The number of motor feedback units required when the motor moves an exact distance (e.g. 1 inch) is then calculated. A distance which is typically very small, e.g. 0.015", is then calculated in terms of motor feedback units. This distance is recorded such that if the system is "jammed" or otherwise prevented from moving by an amount, measured in motor feedback units, greater than calculated, then the system will shut down so as to prevent damaging the machine, for example breaking machine gauge parts during the homing of the needle bar.

The linear transducer's position, and thus the needle bar's position, is measured by the computational unit. A distance is calculated in motor feedback units which corresponds to the distance and direction of travel required so as to move the needle bar to a predetermined position, which corresponds to the home position. All motion for the rest of the machines operation will be in relationship to this known starting location.

It must be noted that although this sequence describes the steps for homing a singular system, if more than one actuator is present on a machine, then the following steps are repeated for each system, either sequentially, one system at a time, or in parallel for more than one system performing the homing functions at the same time.

While preferred embodiments of the invention have been disclosed in the foregoing specification, it is understood by those skilled in the art that variations and modifications thereof can be made without departing from the spirit and scope of the invention, as set forth in the following claims. Moreover, the corresponding structures, materials, acts, and equivalents of all means or step plus function elements in the claims are intended to include any structure, material, or acts for performing the functions in combination with other claimed elements, as specifically claimed herein.

I claim:

1. A tufting machine for creating tufted articles by inserting yarn into a backing, the tufting machine having a frame, a bed supported by the frame, a needle bar carried by the frame and positioned above the bed, a backing feed roll for moving the backing in a path of travel over the bed and beneath the needle bar, the needle bar having spaced needles for inserting the yarns into the backing, loopers positioned beneath the needle bar, and a drive mechanism carried by the frame and connected to the needle bar for causing the needle bar to reciprocate toward and away from the backing as the backing is moved along the path of travel, said drive mechanism comprising an inverted roller screw linear actuator including a servo motor having an armature, an actuator shaft, a roller screw driven by said servo motor and a position feedback device, the tufting machine further comprising a computer in communication with said drive mechanism, said computer having a software control program for controlling the reciprocation of the needle bar.

2. The tufting machine of claim 1, wherein said position feedback device transmits a signal indicative of the rotational position of the servo motor's armature to the computer, and the computer further includes a software program for translating the signal to determine the linear position of the actuator shaft.

3. The tufting machine of claim 1, wherein said position feedback device comprises an encoder.

4. The tufting machine of claim 2, wherein said position feedback device comprises an encoder.

5. The tufting machine of claim 1, wherein said position feedback device comprises a linear transducer.

6. The tufting machine of claim 1, wherein said position feedback device comprises a resolver.

7. The tufting machine of claim 2, wherein said position feedback device comprises a resolver.

8. The tufting machine of claim 1, wherein said position feedback device comprises an encoder which transmits a signal to the computer for determining the linear position of the actuator shaft.

9. The tufting machine of claim 1, wherein said tufting machine includes two or more drive mechanisms spaced from one another in a direction transverse to the path of travel of said backing material, each of said drive mechanisms being connected to said needle bar for reciprocating said needle bar.

10. A tufting machine for creating tufted articles by inserting yarns into a backing, the tufting machine having a frame, a main drive shaft supported by the frame, a drive motor for rotating the main drive shaft, a bed supported by the frame, a shiftable needle bar mechanically connected to the main drive shaft and positioned above the bed for reciprocation toward and away from the bed, a backing feed roll for moving the backing in a path of travel over the bed and beneath the shiftable needle bar, said needle bar including spaced needles, loopers positioned beneath said needle bar, a drive mechanism mounted to the frame and connected to the needle bar for shifting the needle bar in a direction transverse to the path of travel of the backing, said drive mechanism comprising an inverted roller screw linear actuator including a servo motor having an armature, an actuator shaft, a roller screw driven by said servo motor and a position feedback device, the tufting machine further comprising a computer in connection with said drive mechanism, said computer having a software control program for controlling the transverse shifting of the needle bar.

11. The tufting machine of claim 10, wherein said computer is in connection with said drive mechanism through wired, electronic control interfacing.

12. The tufting machine of claim 10, wherein said computer is in connection with said drive mechanism through a fiber optic network.

13. The tufting machine of claim 10, wherein said position feedback device comprises an encoder which transmits a signal to the computer for determining the linear position of the actuator shaft.

14. The tufting machine of claim 10, wherein said tufting machine includes two shiftable needle bars and wherein each shiftable needle bar is connected to and driven by a separate drive mechanism.

15. The tufting machine of claim 10, wherein said position feedback device transmits a signal indicative of the rotational position of the servo motor's armature to the computer, and the computer further includes a software program for translating the signal to determine the linear position of the actuator shaft.

16. The tufting machine of claim 10, wherein said position feedback device comprises an encoder.

17. The tufting machine of claim 15, wherein said position feedback device comprises an encoder.

18. The tufting machine of claim 10, wherein said position feedback device comprises a linear transducer.

19. The tufting machine of claim 10, wherein said position feedback device comprises a resolver.

20. The tufting machine of claim 15, wherein said position feedback device comprises a resolver.

21. The tufting machine of claim 10, wherein said software control program includes a pre-programmed data table for controlling the transverse shifting of the needle bar.

22. The tufting machine of claim 10, wherein said computer includes an input/output adapter for receiving signals emitted from said position feedback device and for emitting return control signals to said drive mechanism.

23. The tufting machine of claim 22, and a magnetic floppy disk drive electronically connected to said computer for receiving a magnetic floppy disk which includes computing instructions for transmission to said computer.

24. The tufting machine of claim 22, and a digital tape drive electronically connected to said computer for receiving a digital tape which includes computing instructions for transmission to said computer.

25. The tufting machine of claim 22, and a CD-ROM drive electronically connected to said computer for receiving a CD-ROM which includes computing instructions for transmission to said computer.

26. The tufting machine of claim 22, and a DVD-CD drive electronically connected to said computer for receiving a DVD-CD which includes computing instructions for transmission to said computer.

27. The tufting machine of claim 22, and an analog to digital converter electronically connected to said input/output adapter.

28. The tufting machine of claim 22, and a digital to analog converter electronically connected to said input/output adapter.

29. The tufting machine of claim 10, wherein said software control program includes a pre-programmed cam profile.

30. The tufting machine of claim 10, and a positional computational unit electronically connected to said computer for delivering a signal to said computer relating to the linear position of said actuator shaft and for delivering a signal to said drive mechanism relating to the desired linear position of said actuator shaft.

31. The tufting machine of claim 10, and a linear feedback conversion unit electronically connected to said computer for delivering a signal to said computer relating to the linear position of said actuator shaft.

32. The tufting machine of claim 10, and a proximity switch mounted to said frame and electronically connected to said computer for monitoring the position of the needle bar for delivering a signal to said computer indicative of the linear position of said needle bar.

33. The tufting machine of claim 10, and a limit switch electronically connected to said drive mechanism and to said computer.

34. The tufting machine of claim 10, and a lubrication assembly connected to said drive mechanism to lubricate and to cool said drive mechanism, said lubrication system including an oil pump, piping connected to said oil pump and a pressure regulator connected to said piping.

35. The tufting machine of claim 10, and an absolute position sensor assembly electronically connected to said computer.

36. The tufting machine of claim 35, wherein said absolute position sensor assembly comprises a proximity switch mounted to said frame and a magnet mounted to said main drive shaft.

37. The tufting machine of claim 10, and a rotary feedback assembly electronically connected to said computer for delivering a signal relating to the rotary position of said main drive shaft.

38. The tufting machine of claim 37, wherein said rotary feedback assembly comprises an encoder.

39. The tufting machine of claim 10, and a drive electronically connected to said drive mechanism, and a positional computational unit electrically connected to said drive and to said computer.

40. The tufting machine of claim 10, and an operator interface electronically connected to said computer.

41. A carpet tufting machine for placing yarns into a backing material in a tufting zone to create tufted articles, said tufting machine including a main drive shaft, rods connected to said main drive shaft and extending toward said tufting zone, a needle bar connected to said rods for reciprocal movement toward and away from said tufting zone and for transverse movement, needles mounted to said needle bar, a looper assembly positioned below said needles, a position sensor operably connected to said main drive shaft for determining the rotational position of said main drive shaft, a computer electronically connected to said position sensor, a first inverted roller screw linear actuator connected to said needle bar for transversely shifting said needle bar, said first inverted roller screw linear actuator including a servo motor, an actuator shaft and a position feedback device, said first inverted roller screw linear actuator also being in electronic communication with said computer.

42. The carpet tufting machine of claim 41, wherein said position feedback device comprises an encoder.

43. The carpet tufting machine of claim 41, wherein said position feedback device comprises a linear transducer.

44. The carpet tufting machine of claim 41, wherein said computer includes a memory for storing computer programs for controlling the transverse shifting of the needle bar.

45. The carpet tufting machine of claim 41, wherein said computer includes a central processing unit, a data input device, an operator interface, a first input/output adapter for uploading data and a second input/output adapter for receiving electronic signals from said position feedback device and for emitting return control signals to said first linear actuator.

46. The carpet tufting machine of claim 41, wherein said computer includes a memory to store a computer software program for controlling said first linear actuator.

47. The carpet tufting machine of claim 41, wherein said computer receives a first electronic signal from said position sensor and emits a second electronic signal to said first linear actuator for causing said first linear actuator to transversely shift said needle bar.

48. The carpet tufting machine of claim 41, wherein said computer includes a memory for storing computer software programs to determine the linear position of the actuator shaft of said linear actuator.

49. The carpet tufting machine of claim 47, wherein said computer includes a memory for storing computer software programs to determine the linear position of the actuator shaft of said linear actuator.

50. The carpet tufting machine of claim 41, wherein said servo motor includes an armature, and said position feedback device generates an electronic signal indicative of the rotational position of said armature, said electronic signal being transmitted to said computer, said computer including a computer software program for translating said rotational position of said armature into the linear position of said actuator shaft of said first linear actuator.

51. The carpet tufting machine of claim 46, said computer including an analog to digital converter.

52. The carpet tufting machine of claim 46, said computer including a digital to analog converter.

53. The carpet tufting machine of claim 46, said computer including a digital to analog converter and an analog to digital converter.

54. The carpet tufting machine of claim 41, wherein said position feedback device generates an electronic signal indicative of the rotational position of said servo motor, said electronic signal being transmitted to said computer, said computer including a computer software program for translating said rotational position of said servo motor into the linear position of said first actuator shaft.

55. A carpet tufting machine for placing yarns into a backing material in a tufting zone to create tufted articles, said tufting machine including a main drive shaft, rods connected to said main drive shaft and extending toward said tufting zone, a needle bar mounted to said rods for reciprocal movement toward and away from said tufting zone and for transverse movement, needles mounted to said needle bar, a looper assembly positioned below said needles for movement toward and away from said needles, a position sensor operably connected to said main drive shaft for determining the rotational position of said main drive shaft, a computer electronically connected to said position sensor, a first inverted roller screw linear actuator connected to said needle bar for transversely shifting said needle bar, said first inverted roller screw linear actuator including a servo motor, an actuator shaft and a position feedback device, a second inverted roller screw linear actuator operatively connected to said looper assembly, said second inverted roller screw linear actuator including a servo motor, an actuator shaft and a position feedback device, said first inverted roller screw linear actuator and said second inverted roller screw linear actuator also being in electronic communication with said computer.

56. The carpet tufting machine of claim 53, wherein said position feedback device of said second inverted roller screw linear actuator comprises an encoder.

57. The carpet tufting machine of claim 53, wherein said position feedback device of said second inverted roller screw linear actuator comprises a linear transducer.

58. The carpet tufting machine of claim 55, wherein said computer includes a memory for storing a computer program for controlling the movement of the looper assembly.

59. The carpet tufting machine of claim 52, wherein said computer includes a central processing unit, a data input device, an operator interface, a first input/output adapter for uploading data and a second input/output adapter for receiving electronic signals from said position feedback device and for emitting return control signals to said first inverted roller screw linear actuator and to said second inverted roller screw linear actuator.

60. The carpet tufting machine of claim 53, wherein said computer includes a memory to store a software program for controlling said first inverted roller screw linear actuator and said second inverted roller screw linear actuator.

61. The carpet tufting machine of claim 53, wherein said computer receives a first electronic signal from said position sensor and emits a third electronic signal to said second inverted roller screw linear actuator for causing said second inverted roller screw linear actuator to move said looper assembly.

62. The carpet tufting machine of claim 53, wherein said computer includes a memory for storing a computer software program to determine the linear position of the actuator shaft of said second inverted roller screw linear actuator.

63. The carpeting tufting machine of claim 61, wherein said computer includes a memory for storing a computer software program to determine the linear position of the actuator shaft of said second inverted roller screw linear actuator.

64. The carpet tufting machine of claim 53, wherein said servo motor of said second inverted roller screw linear actuator includes an armature, and said position feedback device of said second linear actuator generates an electronic signal indicative of the rotational position of said armature, said electronic signal being transmitted to said computer, said computer including a computer software program for translating said rotational position of said armature of said second inverted roller screw linear actuator into the linear position of said actuator shaft of said second inverted roller screw linear actuator.

65. The carpet tufting machine of claim 60, said computer including an analog to digital converter.

66. The carpet tufting machine of claim 60, said computer including a digital to analog converter.

67. The carpet tufting machine of claim 60, said computer including a digital to analog converter and an analog to digital converter.

68. The carpet tufting machine of claim 53, wherein said position feedback device of said second inverted roller screw linear actuator generates an electronic signal indicative of the rotational position of said servo motor of said second inverted roller screw linear actuator, said electronic signal being transmitted to said computer, said computer including a computer software program for translating said rotational position of said servo motor of said second inverted roller screw linear actuator into the linear position of said actuator shaft of said second inverted roller screw linear actuator.

69. A carpet tufting machine for placing yarns into a backing material in a tufting zone to create tufted articles, said tufting machine including a main drive shaft, rods connected to said main drive shaft and extending toward said tufting zone, a needle bar mounted to said rods for reciprocal movement toward and away from said tufting zone and for transverse movement, needles mounted to said needle bar, a looper assembly positioned below said needles for movement toward and away from said needles, a position sensor operably connected to said main drive shaft for determining the rotational position of said main drive shaft, a computer electronically connected to said position sensor, an inverted roller screw linear actuator operatively connected to said looper assembly, said inverted roller screw linear actuator including a servo motor, an actuator shaft and a position feedback device, said inverted roller screw linear actuator being in electronic communication with said computer.

70. The carpet tufting machine of claim 69, wherein said position feedback device of said inverted roller screw linear actuator comprises an encoder.

71. The carpet tufting machine of claim 69, wherein said position feedback device of said inverted roller screw linear actuator comprises a linear transducer.

72. The carpet tufting machine of claim 69, wherein said computer includes a memory for storing a computer program for controlling the movement of the looper assembly.

73. The carpet tufting machine of claim 70, wherein said computer includes a central processing unit, a data input device, an operator interface, a first input/output adapter for uploading data and a second input/output adapter for receiving electronic signals from said position feedback device and for emitting return control signals to said inverted roller screw linear actuator.

74. The carpet tufting machine of claim 69, wherein said computer includes a memory to store a software program for controlling said inverted roller screw linear actuator.

75. The carpet tufting machine of claim 69, wherein said computer receives an electronic signal from said position sensor and emits an electronic signal to said inverted roller screw linear actuator for causing said inverted roller screw linear actuator to move said looper assembly.

76. The carpet tufting machine of claim 69, wherein said computer includes a memory for storing a computer software program to determine the linear position of the actuator shaft of said inverted roller screw linear actuator.

77. The carpeting tufting machine of claim 75, wherein said computer includes a memory for storing a computer software program to determine the linear position of the actuator shaft of said inverted roller screw linear actuator.

78. The carpet tufting machine of claim 69, wherein said servo motor of said inverted roller screw linear actuator includes an armature, and said position feedback device of said linear actuator generates an electronic signal indicative of the rotational position of said armature, said electronic signal being transmitted to said computer, said computer including a computer software program for translating said rotational position of said armature of said inverted roller screw linear actuator into the linear position of said actuator shaft of said inverted roller screw linear actuator.

79. The carpet tufting machine of claim 74, said computer including an analog to digital converter.

80. The carpet tufting machine of claim 74, said computer including a digital to analog converter.

81. The carpet tufting machine of claim 74, said computer including a digital to analog converter and an analog to digital converter.

82. The carpet tufting machine of claim 69, wherein said position feedback device of said inverted roller screw linear actuator generates an electronic signal indicative of the rotational position of said servo motor of said inverted roller screw linear actuator, said electronic signal being transmitted to said computer, said computer including a computer software program for translating said rotational position of said servo motor of said inverted roller screw linear actuator into the linear position of said actuator shaft of said inverted roller screw linear actuator.

83. A carpet tufting machine for placing yarns into a backing material in a tufting zone to create tufted articles, said tufting machine including a main drive shaft, rods connected to said main drive shaft and extending toward said tufting zone, a needle bar mounted to said rods for reciprocal movement toward and away from said tufting zone and for transverse movement, needles mounted to said needle bar, a looper assembly positioned below said needles for movement toward and away from said needles, a bedrail positioned below said needle bar, a position sensor operably connected to said main drive shaft for determining the rotational position of said main drive shaft, a computer electronically connected to said position sensor, an inverted roller screw linear actuator operatively connected to said bedrail, said inverted roller screw linear actuator including a servo motor, an actuator shaft and a position feedback device, said inverted roller screw linear actuator being in electronic communication with said computer.

84. The carpet tufting machine of claim 83, wherein said position feedback device of said inverted roller screw linear actuator comprises an encoder.

85. The carpet tufting machine of claim 83, wherein said position feedback device of said inverted roller screw linear actuator comprises a linear transducer.

86. The carpet tufting machine of claim 83, wherein said computer includes a memory for storing a computer program for controlling the vertical movement of the bedrail.

87. The carpet tufting machine of claim 84, wherein said computer includes a central processing unit, a data input device, an operator interface, a first input/output adapter for uploading data and a second input/output adapter for receiving electronic signals from said position feedback device and for emitting return control signals to said inverted roller screw linear actuator.

88. The carpet tufting machine of claim 83, wherein said computer includes a memory to store a software program for controlling said inverted roller screw linear actuator.

89. The carpet tufting machine of claim 83, wherein said computer receives an electronic signal from said position sensor and emits an electronic signal to said inverted roller screw linear actuator for causing said inverted roller screw linear actuator to move said bedrail.

90. The carpet tufting machine of claim 83, wherein said computer includes a memory for storing a computer software program to determine the linear position of the actuator shaft of said inverted roller screw linear actuator.

91. The carpeting tufting machine of claim 89, wherein said computer includes a memory for storing a computer software program to determine the linear position of the actuator shaft of said inverted roller screw linear actuator.

92. The carpet tufting machine of claim 83, wherein said servo motor of said inverted roller screw linear actuator includes an armature, and said position feedback device of said linear actuator generates an electronic signal indicative of the rotational position of said armature, said electronic signal being transmitted to said computer, said computer including a computer software program for translating said rotational position of said armature of said inverted roller screw linear actuator into the linear position of said actuator shaft of said inverted roller screw linear actuator.

93. The carpet tufting machine of claim 88, said computer including an analog to digital converter.

94. The carpet tufting machine of claim 88, said computer including a digital to analog converter.

95. The carpet tufting machine of claim 88, said computer including a digital to analog converter and an analog to digital converter.

96. The carpet tufting machine of claim 83, wherein said position feedback device of said inverted roller screw linear actuator generates an electronic signal indicative of the rotational position of said servo motor of said inverted roller screw linear actuator, said electronic signal being transmitted to said computer, said computer including a computer software program for translating said rotational position of said servo motor of said inverted roller screw linear actuator into the linear position of said actuator shaft of said inverted roller screw linear actuator.

* * * * *

UNITED STATES PATENT AND TRADEMARK OFFICE

CERTIFICATE OF CORRECTION

PATENT NO. : 5,979,344
DATED : November 9, 1999
INVENTOR(S) : William M. Christman, Jr.

It is certified that error appears in the above-identified patent and that said Letters Patent is hereby corrected as shown below:

Column 3,
Line 29, change "and/or" to -- or --.

Column 4,
Line 50, change "FIG 3 is a schematic illustration" to -- FIGS. 3A - 3B are schematic illustrations --.

Column 5,
Line 1, change "FIG. 6 is a schematic illustration" to -- FIGS. 6A-6B are schematic illustrations --.
Line 4, change "FIG. 7 is a schematic illustration" to -- FIGS. 7A-7B are schematic illustrations --.
Line 7, change "FIG. 8 is a schematic illustration" to -- FIGS. 8A-8B are schematic illustrations --.
Line 10, change "FIG. 9 is a schematic illustration" to -- FIGS. 9A-9B are schematic illustrations --.
Line 13, change "FIG. 10 is a schematic illustration" to -- FIGS. 10A-10B are schematic illustrations --.
Line 16, change "FIG. 11 is a schematic illustration to -- FIGS. 11A-11B are schematic illustrations --.
Line 59, delete "19".
Line 62, change "3" to -- 3A-3B --.

Column 6,
Line 12, change "in" to -- an --.

Column 7,
Line 50, change "6-11" to -- 6A-11B --.

UNITED STATES PATENT AND TRADEMARK OFFICE

CERTIFICATE OF CORRECTION

PATENT NO. : 5,979,344
DATED : November 9, 1999
INVENTOR(S) : William M. Christman, Jr.

It is certified that error appears in the above-identified patent and that said Letters Patent is hereby corrected as shown below:

Column 8,
Line 3, change "7, and 11" to -- 7A-7B and 11A-11B --.
Line 47, change "6 and 10" to -- 6A-6B and 10-10B --.
Line 57, change "6 and 10" to -- 6A-10B --.

Signed and Sealed this

Twenty-fourth Day of July, 2001

Nicholas P. Godici

*Attest:*

*Attesting Officer*

NICHOLAS P. GODICI
*Acting Director of the United States Patent and Trademark Office*